US012049690B2

(12) United States Patent
Yoshida et al.

(10) Patent No.: US 12,049,690 B2
(45) Date of Patent: Jul. 30, 2024

(54) COPPER ALLOY PLATE AND METHOD FOR PRODUCING SAME

(71) Applicant: DOWA METALTECH CO., LTD., Tokyo (JP)

(72) Inventors: Kazuki Yoshida, Tokyo (JP); Takanobu Sugimoto, Tokyo (JP); Tomotsugu Aoyama, Tokyo (JP); Hiroto Narieda, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 0 days.

(21) Appl. No.: 17/602,391

(22) PCT Filed: Jan. 30, 2020

(86) PCT No.: PCT/JP2020/003320
§ 371 (c)(1),
(2) Date: Oct. 8, 2021

(87) PCT Pub. No.: WO2020/213224
PCT Pub. Date: Oct. 22, 2020

(65) Prior Publication Data

US 2022/0162734 A1 May 26, 2022

(30) Foreign Application Priority Data

Apr. 16, 2019 (JP) ..... 2019-077509

(51) Int. Cl.
*C22F 1/08* (2006.01)
*C22C 9/04* (2006.01)

(52) U.S. Cl.
CPC . *C22F 1/08* (2013.01); *C22C 9/04* (2013.01)

(58) Field of Classification Search
CPC ..... C22F 1/08; C22F 1/00; C22C 9/04; H01B 1/02; H01B 13/00; H01R 13/03
See application file for complete search history.

(56) References Cited

U.S. PATENT DOCUMENTS

2004/0234411 A1* 11/2004 Hofmann ..... C22C 9/04 420/473

FOREIGN PATENT DOCUMENTS

| | | | | |
|---|---|---|---|---|
| JP | 2001164328 | A | | 6/2001 |
| JP | 2002088428 | A | | 3/2002 |
| JP | 2004224645 | A | | 8/2004 |
| JP | 200962610 | A | | 3/2009 |
| JP | 2009062610 | A | * | 3/2009 |
| JP | 2018070944 | A | | 5/2018 |
| WO | 2019171951 | A | | 9/2019 |

OTHER PUBLICATIONS

Ko et al., JP-2009062610-A. machine translation. (Year: 2009).*
International search report for patent application No. PCT/JP2020/003320 dated Apr. 6, 2020.

* cited by examiner

*Primary Examiner* — John A Hevey
(74) *Attorney, Agent, or Firm* — Bachman & LaPointe, P.C.

(57) ABSTRACT

There are provided an inexpensive copper alloy plate having excellent bending workability, excellent stress corrosion cracking resistance and excellent stress relaxation resistance while maintaining the high strength thereof, and a method for producing the same. The copper alloy plate has a chemical composition which contains 17 to 32% by weight of zinc, 0.1 to 4.5% by weight of tin, 0.5 to 2.5% by weight of silicon, 0.01 to 0.3% by weight of phosphorus and the balance being copper and unavoidable impurities, the total of the content of silicon and six times as much as the content of phosphorus being 1% by weight or more, the copper alloy plate having a crystal orientation wherein I{220}/I{420} in the range of from 2.5 to 8.0 assuming that the X-ray diffraction intensity on {220} crystal plane on the plate surface of the copper alloy plate is I{220} and that the X-ray diffraction intensity on {420} crystal plane thereon is I{420}.

14 Claims, No Drawings

COPPER ALLOY PLATE AND METHOD FOR PRODUCING SAME

TECHNICAL FIELD

The present invention generally relates to a copper alloy plate and a method for producing the same. More specifically, the invention relates to a copper alloy plate, such as a Cu—Zn—Sn—Si—P based alloy plate, which is used for electric and electronic parts, such as connectors, lead frames, relays and switches, and a method for producing the same.

BACKGROUND ART

The materials used for electric and electronic parts, such as connectors, lead frames, relays and switches, are required to have a good electric conductivity in order to suppress the generation of Joule heat due to the carrying of current, as well as such a high strength that the materials can withstand the stress applied thereto during the assembly and operation of electric and electronic apparatuses using the parts. The materials used for electric and electronic parts, such as connectors, are also required to have excellent bending workability since the parts are generally formed by bending. Moreover, in order to ensure the contact reliability between electric and electronic parts, such as connectors, the materials used for the parts are required to have excellent resistance to such a phenomenon (stress relaxation) that the contact pressure between the parts is deteriorated with age, i.e., excellent stress relaxation resistance.

In recent years, there is a tendency for electric and electronic parts, such as connectors, to be integrated, miniaturized and lightened. In accordance therewith, the plates of copper and copper alloys serving as the materials of the parts are required to be thinned, so that the required strength level of the materials is more severe. In accordance with the miniaturization and complicated shape of electric and electronic parts, such as connectors, it is required to improve the precision of shape and dimension of products manufactured by bending the copper alloy plates. In recent years, there is a tendency to proceed with the decrease of environmental load, saving resources and saving energy. In accordance therewith, the plates of copper and copper alloys serving as the materials of the parts are increasingly required to decrease the raw-material costs and production costs and to recycle the products thereof.

However, there are trade-off relationships between the strength and electric conductivity of a plate, between the strength and bending workability thereof and between the bending workability and stress relaxation resistance thereof, respectively. For that reason, a relatively low-cost plate having good electric conductivity, strength, bending workability or stress relaxation resistance is suitably chosen in accordance with the use thereof as conventional plates used for electric and electronic parts, such as connectors.

As conventional general-purpose materials for electric and electronic parts such as connectors, there are used brasses, phosphor bronzes and so forth. Phosphor bronzes have a relatively excellent balance between the strength, corrosion resistance, stress corrosion cracking resistance and stress relaxation resistance of a plate thereof. However, for example, in the case of the second-class phosphor bronze (C5191), it is not possible to carry out the hot-rolling of a plate thereof, and it contains about 6% of expensive tin, so that the costs of the plate thereof are increased.

On the other hand, brasses (Cu—Zn based alloys) are widely used as materials having low raw-material costs and low production costs and having excellent recycling efficiencies of products thereof. However, the strength of brasses is lower than that of phosphor bronzes. The temper designation of a brass having the highest strength is EH (H06). For example, the plate product of the first-class brass (C2600-SH) generally has a tensile strength of about 550 MPa which is comparable with the tensile strength of the temper designation H (H04) of the second-class phosphor bronze. In addition, the plate product of the first-class brass (C2600-SH) does not have excellent stress corrosion cracking resistance.

In order to improve the strength of brasses, it is required to increase the finish rolling reduction (to increase the temper designation). In accordance therewith, the bending workability in directions perpendicular to the rolling directions (i.e., the bending workability in directions in which the bending axis extends in directions parallel to the rolling directions) is remarkably deteriorated. For that reason, even if a brass having a high strength level is used as the material, there are some cases where it is not possible to work the plate to produce an electric and electronic part such as a connector. For example, if the finish rolling reduction of a plate of the first-class brass is increased to cause the tensile strength to be higher than 570 MPa, it is difficult to press the plate to produce a small product.

In particular, in the case of a brass being a simple alloy of copper and zinc, it is not easy to improve the bending workability thereof while maintaining the strength thereof. For that reason, there is improved to enhance the strength level by adding various elements to brasses. For example, there are proposed copper-zinc based alloys wherein a third element, such as tin, silicon or nickel, is added thereto (see, e.g., Patent Documents 1-3).

PRIOR ART DOCUMENT(S)

Patent Document(s)

Patent Document 1: Japanese Patent Laid-Open No. 2001-164328 (Paragraph Number 0013)
Patent Document 2: Japanese Patent Laid-Open No. 2002-88428 (Paragraph Number 0014)
Patent Document 3: Japanese Patent Laid-Open No. 2009-62610 (Paragraph Number 0019)

SUMMARY OF THE INVENTION

Problem to be Solved by the Invention

However, even if tin, silicon, nickel or the like is added to a brass (a copper-zinc based alloy), there are some cases where it is not possible to sufficiently improve the bending workability of a plate thereof.

It is therefore an object of the present invention to eliminate the aforementioned conventional problems and to provide an inexpensive copper alloy plate having excellent bending workability, excellent stress corrosion cracking resistance and excellent stress relaxation resistance while maintaining the high strength thereof, and a method for producing the same.

Means for Solving the Problem

In order to accomplish the aforementioned object, the inventors have diligently studied and found that it is possible to produce an inexpensive copper alloy plate having excellent bending workability, excellent stress corrosion cracking resistance and excellent stress relaxation resistance while maintaining the high strength thereof, if the copper alloy plate has a chemical composition comprising 17 to 32% by weight of zinc, 0.1 to 4.5% by weight of tin, 0.5 to 2.5% by weight of silicon, 0.01 to 0.3% by weight of phosphorus, and the balance being copper and unavoidable impurities, the total of the content of silicon and six times as much as the content of phosphorus being 1% by weight or more, and if the copper alloy plate has a crystal orientation wherein I{220}/I{420} is in the range of from 2.5 to 8.0 assuming that the X-ray diffraction intensity on {220} crystal plane on the plate surface of the copper alloy plate is I{220} and that the X-ray diffraction intensity on {420} crystal plane thereon is I{420}. Thus, the inventors have made the present invention.

According to the present invention, there is provided a copper alloy plate which has a chemical composition comprising 17 to 32% by weight of zinc, 0.1 to 4.5% by weight of tin, 0.5 to 2.5% by weight of silicon, 0.01 to 0.3% by weight of phosphorus, and the balance being copper and unavoidable impurities, the total of the content of silicon and six times as much as the content of phosphorus being 1% by weight or more, the copper alloy plate having a crystal orientation wherein I{220}/I{420} is in the range of from 2.5 to 8.0 assuming that the X-ray diffraction intensity on {220} crystal plane on the plate surface of the copper alloy plate is I{220} and that the X-ray diffraction intensity on {420} crystal plane thereon is I{420}.

The chemical composition of the copper alloy plate may further comprise 1% by weight or less of nickel, and may further comprise one or more elements which are selected from the group consisting of cobalt, iron, chromium, manganese, magnesium, zirconium, titanium, antimony, aluminum, boron, lead, bismuth, cadmium, gold, silver, beryllium, tellurium, yttrium and arsenic, the total amount of these elements being 3% by weight or less. The copper alloy plate preferably has a mean crystal grain size of 3 to 20 μm.

The copper alloy plate preferably has a tensile strength of not lower than 650 MPa when a tension test based on JIS 22241 is carried out with respect to a test piece TD (No. 5 test piece based on JIS 22201) for tension test, the test piece being cut out from the copper alloy, the longitudinal directions of the test piece being directions TD (directions perpendicular to the rolling and thickness directions of the copper alloy plate) while the width directions of the test piece being directions LD (rolling directions of the copper alloy plate). The copper alloy plate preferably has a tensile strength of not lower than 550 MPa when a tension test based on JIS 22241 is carried out with respect to a test piece LD (No. 5 test piece based on JIS 22201) for tension test, the test piece being cut out from the copper alloy, the longitudinal directions of the test piece being directions LD (rolling directions of the copper alloy plate) while the width directions of the test piece being directions TD (directions perpendicular to the rolling and thickness directions of the copper alloy plate). In this case, the ratio of the tensile strength of the test piece TD to the tensile strength of the test piece LD is preferably not less than 1.05.

According to the present invention, there is provided a method for producing a copper alloy plate, the method comprising the steps of: melting and casting raw materials of a copper alloy which has a chemical composition comprising 17 to 32% by weight of zinc, 0.1 to 4.5% by weight of tin, 0.5 to 2.5% by weight of silicon, 0.01 to 0.3% by weight of phosphorus, and the balance being copper and unavoidable impurities, the total of the content of silicon and six times as much as the content of phosphorus being 1% by weight or more; hot-rolling the cast copper alloy at a rolling reduction of 90% or more in a temperature range of from 900° C. to 300° C., the hot-rolling being carried out at a rolling reduction of 10% or more in a rolling path in a temperature range of 650° C. or lower; first cold-rolling the hot-rolled copper alloy at a rolling reduction of 50% or more; carrying out an intermediate-annealing for holding the first-cold-rolled copper alloy at a temperature of 400 to 800° C. for 1 hour or more; second cold-rolling the intermediate-annealed copper alloy at a rolling reduction of 40% or more; carrying out a final intermediate-annealing for holding the second-cold-rolled copper alloy at a temperature of 550 to 850° C. for 60 seconds or less; finish cold-rolling the final-intermediate-annealed copper alloy at a rolling reduction of 30% or less; and carrying out a low-temperature annealing for holding the finish-cold-rolled copper alloy at a temperature of 500° C. or lower.

In this method for producing a copper alloy plate, the chemical composition of the copper alloy plate may further comprise 1% by weight or less of nickel, and may further comprise one or more elements which are selected from the group consisting of cobalt, iron, chromium, manganese, magnesium, zirconium, titanium, antimony, aluminum, boron, lead, bismuth, cadmium, gold, silver, beryllium, tellurium, yttrium and arsenic, the total amount of these elements being 3% by weight or less. The final intermediate-annealing preferably causes the copper alloy to have a mean crystal grain size of 3 to 20 μm. The finish cold-rolling is preferably carried out by setting a back tension of not lower than 1 $kg/mm^2$ and a forward tension of not lower than 5 $kg/mm^2$.

According to the present invention, there is provided a connector terminal, the material of which is the above-described copper alloy plate.

Effects of the Invention

According to the present invention, it is possible to produce an inexpensive copper alloy plate having excellent bending workability, excellent stress corrosion cracking resistance and excellent stress relaxation resistance while maintaining the high strength thereof.

MODE FOR CARRYING OUT THE INVENTION

The preferred embodiment of a copper alloy plate according to the present invention has a chemical composition comprising 17 to 32% by weight of zinc, 0.1 to 4.5% by weight of tin, 0.5 to 2.5% by weight of silicon, 0.01 to 0.3% by weight of phosphorus, and the balance being copper and unavoidable impurities, the total of the content of silicon and six times as much as the content of phosphorus being 1% by weight or more, the copper alloy plate having a crystal orientation wherein I{220}/I{420} is in the range of from 2.5 to 8.0 assuming that the X-ray diffraction intensity on {220} crystal plane on the plate surface of the copper alloy plate is I{220} and that the X-ray diffraction intensity on {420} crystal plane thereon is I{420}.

The preferred embodiment of a copper alloy plate according to the present invention is a Cu—Zn—Sn—Si—P based alloy wherein Sn, Si and P are added to a Cu—Zn based alloy containing Cu and Zn.

Zinc has the function of improving the strength and spring property of the copper alloy plate. Since zinc is cheaper than copper, a large amount of zinc is preferably added to the copper alloy. However, if the content of zinc exceeds 32% by weight, beta (β) phase is generated to remarkably deteriorate the cold workability of the copper alloy plate and to deteriorate the stress corrosion cracking resistance thereof. In addition, there is deteriorated the plating and soldering properties thereof due to moisture and heating. On the other hand, if the content of zinc is less than 17% by weight, the strength, such as 0.2% proof stress and tensile strength, and spring property of the copper alloy plate are insufficient, and the Young's modulus thereof is increased. In addition, the amount of hydrogen gas absorption is increased during the melting of the copper alloy plate, and blowholes are easily generated in the ingot of the copper alloy. Moreover, the amount of inexpensive zinc is small in the copper alloy plate, so that the costs thereof are increased. Therefore, the content of zinc is preferably 17 to 32% by weight, more preferably 17 to 27% by weight, and most preferably 18 to 23% by weight.

Tin has the function of improving the strength, stress relaxation resistance and stress corrosion cracking resistance of the copper alloy plate. In order to reuse materials, which are surface-treated with tin, such as tin-plated materials, the copper alloy plate preferably contains tin. However, if the content of tin in the copper alloy plate exceeds 4.5% by weight, the electric conductivity of the copper alloy plate is suddenly lowered, and the segregation in the grain boundaries of the copper alloy is violently increased in the presence of zinc, so that the hot workability of the copper alloy plate is remarkably deteriorated. On the other hand, if the content of tin is less than 0.1% by weight, the function of improving the mechanical characteristics of the copper alloy plate is decreased, and it is difficult to use pressed scraps and so forth, which are plated with tin or the like, as the raw materials of the copper alloy plate. Therefore, the content of tin is preferably 0.1 to 4.5% by weight, more preferably 0.3 to 2.5% by weight, and most preferably 0.5 to 1.0% by weight.

Silicon has the function of improving the stress corrosion cracking resistance of the copper alloy plate even if the content of silicon therein is small. In order to sufficiently obtain this function, the content of silicon is preferably not less than 0.5% by weight. However, if the content of silicon exceeds 2.5% by weight, the electric conductivity of the copper alloy plate is easily lowered. In addition, silicon is an easily oxidized element to easily deteriorate the castability of the copper alloy, so that the content of silicon is preferably not too large. Therefore, the content of silicon is preferably 0.5 to 2.5% by weight, more preferably 0.7 to 2.3% by weight and most preferably 1 to 2% by weight.

Phosphorus has the function of improving the stress corrosion cracking resistance of the copper alloy plate. In order to sufficiently obtain this function, the content of phosphorus is preferably larger than 0.01% by weight. However, if the content of phosphorus exceeds 0.3% by weight, the hot workability of the copper alloy plate is remarkably deteriorated, so that the content of phosphorus is preferably not too large. Therefore, the content of phosphorus is preferably 0.01 to 0.3% by weight, and more preferably 0.03 to 0.25% by weight. In addition, the total of the content of silicon and six times as much as the content of phosphorus is preferably 1% by weight or more. If this total is lower than 1% by weight, the stress corrosion cracking resistance of the copper alloy plate is deteriorated. On the other hand, if the total of the content of silicon and six times as much as the content of phosphorus exceeds 4.5% by weight, there are some cases where the hot workability of the copper alloy plate is deteriorated. Therefore, the total of the content of silicon and six times as much as the content of phosphorus is preferably 4.5% by weight or less, and more preferably 1 to 3% by weight.

The chemical composition of the copper alloy plate may further comprise 1% by weight or less (preferably 0.7% by weight or less, more preferably 0.6% by weight or less) of nickel. The chemical composition of the copper alloy may further comprise one or more elements which are selected from the group consisting of cobalt, iron, chromium, manganese, magnesium, zirconium, titanium, antimony, aluminum, boron, lead, bismuth, cadmium, gold, silver, beryllium, tellurium, yttrium and arsenic, the total amount of these elements being 3% by weight or less (preferably 1% by weight or less, more preferably 0.5% by weight or less).

The copper alloy plate has a crystal orientation wherein I{220}/I{420} is in the range of from 2.5 to 8.0 (preferably in the range of from 2.5 to 6.0) assuming that the X-ray diffraction intensity on {220} crystal plane on the plate surface of the copper alloy plate is I{220} and that the X-ray diffraction intensity on {420} crystal plane thereon is I{420}. If I{220}/I{420} of the copper alloy plate is too large, the bending workability of the copper alloy plate is deteriorated. On the other hand, I{220}/I{420} of the copper alloy plate is too small, it is not possible to maintain the high tensile strength thereof in directions TD (directions perpendicular to the rolling and thickness directions) of the copper alloy plate.

The mean crystal grain size of the copper alloy plate is preferably 20 μm or less, more preferably 18 μm or less, and still more preferably 17 μm or less, since the bending workability of the copper alloy plate is more advantageously improved as the mean crystal grain size of the copper alloy plate is smaller. On the other hand, the mean crystal grain size of the copper alloy plate is preferably 3 μm or more, and more preferably 5 μm or more, since there are some cases where the stress relaxation resistance of the copper alloy plate is deteriorated if the mean crystal grain size of the copper alloy plate is too small.

The electric conductivity of the copper alloy plate is preferably not lower than 8% IACS, and more preferably not lower than 8.5% IACS, in order to suppress the generation of Joule heat due to the carrying of current in accordance with the high integration of electric and electronic parts, such as connectors.

In order to miniaturize and thin electric and electronic parts, such as connectors, when the copper alloy plate is used as the material of the electric and electronic parts, the 0.2% proof stress of the copper alloy plate is preferably not lower than 450 MPa (more preferably not lower than 500 MPa, still more preferably not lower than 530 MPa and most preferably not lower than 540 MPa) when a tension test based on JIS 22241 is carried out with respect to a test piece LD (No. 5 test piece based on JIS 22201) for tension test, the test piece being cut out from the copper alloy, the longitudinal directions of the test piece being directions LD (rolling directions of the copper alloy plate) while the width directions of the test piece being directions TD (directions perpendicular to the rolling and thickness directions of the copper alloy plate), and the 0.2% proof stress of the copper alloy plate is preferably not lower than 480 MPa (more preferably not lower than 550 MPa, still more preferably not lower than 570 MPa and most preferably not lower than 580 MPa) when a tension test based on JIS 22241 is carried out with respect to a test piece TD (No. 5 test piece based on JIS Z2201) for tension test, the test piece being cut out from the copper alloy, the longitudinal directions of the test piece being directions TD (directions perpendicular to the rolling and thickness directions of the copper alloy plate) while the width directions of the test piece being directions LD (rolling directions of the copper alloy plate), the ratio of the 0.2% proof stress of the test piece TD to the 0.2% proof stress of the test piece LD being preferably 1.05 or more.

In order to miniaturize and thin electric and electronic parts, such as connectors, when the copper alloy plate is used as the material of the electric and electronic parts, the tensile strength of the copper alloy plate is preferably not lower than 550 MPa (more preferably not lower than 600 MPa and most preferably not lower than 620 MPa) when a tension test based on JIS Z2241 is carried out with respect to a test piece LD (No. 5 test piece based on JIS 22201) for tension test, the test piece being cut out from the copper alloy, the longitudinal directions of the test piece being directions LD (rolling directions of the copper alloy plate) while the width directions of the test piece being directions TD (directions perpendicular to the rolling and thickness directions of the copper alloy plate), and the tensile strength of the copper alloy plate is preferably not lower than 580 MPa (more preferably not lower than 650 MPa and most preferably not lower than 670 MPa) when a tension test based on JIS 22241 is carried out with respect to a test piece TD (No. 5 test piece based on JIS 22201) for tension test, the test piece being cut out from the copper alloy, the longitudinal directions of the test piece being directions TD (directions perpendicular to the rolling and thickness directions of the copper alloy plate) while the width directions of the test piece being directions LD (rolling directions of the copper alloy plate), the ratio of the tensile strength of the test piece TD to the tensile strength of the test piece LD being preferably 1.05 or more.

The breaking elongation of the copper alloy plate is preferably 10% or more when a tension test based on JIS 22241 is carried out with respect to a test piece LD (No. 5 test piece based on JIS 22201) for tension test, the test piece being cut out from the copper alloy, the longitudinal directions of the test piece being directions LD (rolling directions of the copper alloy plate) while the width directions of the test piece being directions TD (directions perpendicular to the rolling and thickness directions of the copper alloy plate), and the breaking elongation of the copper alloy plate is preferably 10% or more when a tension test based on JIS Z2241 is carried out with respect to a test piece TD (No. 5 test piece based on JIS 22201) for tension test, the test piece being cut out from the copper alloy, the longitudinal directions of the test piece being directions TD (directions perpendicular to the rolling and thickness directions of the copper alloy plate) while the width directions of the test piece being directions LD (rolling directions of the copper alloy plate).

In order to evaluate the stress relaxation resistance of the copper alloy plate in accordance with the cantilever screw type stress relaxation test prescribed in JEITA EMAS-1011, a test piece (having a length of 60 mm×a width of 10 mm) is cut out from the copper alloy plate so that the longitudinal directions of the test piece are directions LD (the rolling directions of the copper alloy plate) while the width directions thereof are directions TD (directions perpendicular to the rolling and thickness directions of the copper alloy plate). One end portion of the test piece in longitudinal directions thereof is fixed, and the other end portion (free end portion) of the test piece in longitudinal directions thereof is fixed in a state that a load stress corresponding to 80% of the 0.2% proof stress thereof is applied on the other end portion thereof so that the thickness directions of the test piece are deflection directions. After this test piece is held at 150° C., for 1000 hours, the deflection of the test piece is measured. From the rate of variability in the deflection, a stress relaxation rate (%) is calculated. The stress relaxation rate is preferably not higher than 35% and more preferably not higher than 32%.

In order to evaluate the stress corrosion cracking resistance of the copper alloy plate, a test piece (having a width of 10 mm), which is cut out from the copper alloy plate, is held at 25° C. in a desiccator containing 3% by weight of ammonia water in a state that the test piece is bent in the form of an arch so that the surface stress in the central portion in longitudinal directions thereof is 80% of the 0.2% proof stress thereof. With respect to the test piece taken out every one hour, the time when cracks are observed in the test piece at a magnification of 100 by means of an optical microscope is preferably not shorter than 100 hours and more preferably not shorter than 110 hours. This time is preferably longer than twenty times (more preferably longer than twenty-two times) as long as the time (5 hours) in a plate of a commercially-available first-class brass (C2600-H).

In order to evaluate the bending workability of the copper alloy plate, a bending test piece LD (having a width of 20 mm) is cut out from the copper alloy plate so that the longitudinal directions of the test piece are directions LD (rolling directions of the copper alloy plate) while the width directions of the test piece are directions TD (directions perpendicular to the rolling and thickness directions of the copper alloy plate), and a bending test piece TD (having a width of 20 mm) (No. 5 test piece based on JIS 22201) is cut out from the copper alloy plate so that the longitudinal directions of the test piece are directions TD while the width directions of the test piece are directions LD. The W bending test (based on JIS H3130) is carried out with respect to the bending test piece LD so that the bending axis of the bending test piece extends in the directions TD (Goodway bending (G.W. bending)), and the W bending test (based on JIS H3130) is carried out with respect to the bending test piece TD so that the bending axis of the bending test piece extends in the directions LD (BadWay bending (B.W. bending)). The surface and cross-section of the bend section of each of the test pieces LD and TD after the W bending test are observed at a magnification of 100 by means of an optical microscope to obtain a minimum bending radius R in which cracks are not produced. When the minimum bending radius R is divided by the thickness t of the copper alloy plate, the R/t value of the bending test piece LD is preferably 0.3 or less, and the R/t value of the bending test piece TD is preferably 1.7 or less.

The above-described copper alloy plate can be produced by the preferred embodiment of a method for producing a copper alloy plate according to the present invention. The preferred embodiment of a method for producing a copper alloy plate according to the present invention comprises: a melting/casting step of melting and casting raw materials of a copper alloy which has the above-described chemical composition; a hot-rolling step of hot-rolling the copper alloy at a rolling reduction of 90% or more in a temperature range of from 900° C. to 300° C. after the melting/casting step, the hot-rolling being carried out at a rolling reduction of 10% or more (preferably 10 to 35%) in a rolling path in a temperature range of 650° C. or lower (preferably from 650° C. to 300° C.); a first cold-rolling step of first cold-rolling the copper alloy at a rolling reduction of 50% or more after the hot-rolling step; an intermediate-annealing step of carrying out an annealing for holding the copper alloy at a temperature of 400 to 800° C. for 1 hour or more after the first cold-rolling step; a second cold-rolling step of second cold-rolling the copper alloy at a rolling reduction of 40% or more after the intermediate-annealing step; a final intermediate-annealing step of carrying out an annealing for holding the copper alloy at a temperature of 550 to 850° C. for 60 seconds or less after the second cold-rolling step; a finish cold-rolling step of finish cold-rolling the copper alloy at a rolling reduction of 30% or less after the final intermediate-annealing step; and a low-temperature annealing step of carrying out an annealing for holding the copper alloy at a temperature of 500° C. or lower after the finish cold-rolling step. These steps will be described below in detail. Furthermore, facing may be optionally carried out after the hot rolling step. After each heat treatment (annealing), pickling, polishing and degreasing may be optionally carried out.

(Melting and Casting Step)

After the raw materials of a copper alloy are melted, an ingot is produced by a method, which is the same method as a usual method for ingoting a brass, by means of the continuous casting, semi-continuous casting or the like. Furthermore, when the raw materials may be melted in the atmosphere (i.e., an air atmosphere under ordinary pressure).

(Hot-Rolling Step)

The hot-rolling of a copper-zinc based alloy is usually carried out in a high temperature range of not lower than 650° C. or 700° C. in order to cause the destruction of the cast structure and the softening of the materials by recrystallization during the rolling and between the rolling paths. However, on such general hot-rolling conditions, it is difficult to produce a copper alloy plate having a specific texture as the preferred embodiment of a copper alloy plate according to the present invention. That is, even if conditions at subsequent steps are widely changed on such general hot-rolling conditions, it is difficult to produce a copper alloy plate having a crystal orientation wherein I{220}/I{420} is in the range of from 2.5 to 8.0 assuming that the X-ray diffraction intensity on {220} crystal plane on the plate surface of the copper alloy plate is I{220} and that the X-ray diffraction intensity on {420} crystal plane thereon is I{420}. For that reason, in the preferred embodiment of a method for producing a copper alloy plate according to the present invention, the hot-rolling is carried out at a total rolling reduction of 90% or more in a temperature range of from 900° C. to 300° C. at the hot-rolling step while a rolling reduction in a rolling path in a temperature range of 650° C. or lower (preferably from 650° C. to 300° C.) is 10% or more (preferably 10 to 35% and more preferably 10 to 20%). Furthermore, when the hot-rolling of the ingot is carried out, if the initial rolling pass is carried out in a higher temperature range than 650° C. at which recrystallization is easy to occur (preferably in a higher temperature range than 670° C.), it is possible to break the cast structure of the ingot to uniform the components and structures thereof. However, if the hot-rolling of the ingot is carried out at a high temperature exceeding 900° C., there is some possibility that cracks may be produced in portions, such as segregation portions of alloy components, at which the melting point thereof is lowered, so that it is not preferable to carry out the hot-rolling of the ingot at a high temperature exceeding 900° C.

(First Cold-Rolling Step)

At this first cold-rolling step, the total rolling reduction is preferably not less than 50%, more preferably not less than 75% and most preferably not less than 85%.

(Intermediate-Annealing step)

At this intermediate-annealing step, annealing is carried out at a temperature of 400 to 800° C. (preferably 400 to 700° C.). At this intermediate-annealing step, a heat treatment is preferably carried out by setting a holding time and an attainment temperature in a temperature range of from 400° C. to 800° C. (preferably from 400° C. to 700° C., and more preferably from 450° C. to 650° C.) so that the mean crystal grain size after the annealing is not greater than 20 μm (preferably not greater than 18 μm and more preferably not greater than 17 μm) and is not less than 3 μm (preferably not less than 5 μm). Furthermore, the particle diameters of recrystallized grains obtained by this annealing are varied in accordance with the rolling reduction in the cold-rolling before the annealing and in accordance with the chemical composition of the copper alloy plate. However, if the relationship between the annealing heat pattern and the mean crystal grain size is previously obtained by experiments with respect to each of various alloys, it is possible to set the holding time and attainment temperature at a temperature of 400 to 800° C. Specifically, in the case of the chemical composition of a copper alloy plate according to the present invention, it is possible to set appropriate conditions in heating conditions for holding the copper alloy at a temperature of 400 to 800° C. preferably for one hour or more (more preferably for 1 to 10 hours) and at a temperature of 450 to 650° C. preferably for 3 hours or more (more preferably for 3 to 10 hours).

Furthermore, the first cold-rolling step and the intermediate-annealing step may be repeated in this order. When the first cold-rolling step and the intermediate-annealing step are repeated, a heat treatment is preferably carried out at a temperature, which is not lower than that at other intermediate-annealing steps, at the intermediate-annealing (recrystallization annealing) step which is finally carried out (before the second cold-rolling step). The heat treatment at the intermediate-annealing step finally carried out is preferably carried out by setting a holding time and an attainment temperature in a temperature range of from 400° C. to 800° C. (preferably from 400° C. to 700° C. and more preferably from 450° C. to 650° C.) so that the mean crystal grain size after the intermediate-annealing finally carried out is not greater than 20 μm (preferably not greater than 18 μm, and more preferably not greater than 17 μm) and is not less than 3 μm (preferably not less than 5 μm).

(Second Cold Rolling Step)

At this second cold rolling step, the rolling reduction is preferably not less than 40%, and more preferably not less than 50%.

(Final Intermediate-Annealing Step)

At this final intermediate-annealing step, there is carried out an annealing for holding the copper alloy at a temperature of 550 to 850° C. (preferably 600 to 750° C.) for 60 seconds or less (preferably 50 seconds or less, more preferably 40 seconds or less and most preferably 30 seconds or less). If this final intermediate-annealing is carried out, it is possible to obtain a copper alloy plate having a crystal orientation wherein I{220}/I{420} is in the range of from 2.5 to 8.0 (preferably from 2.5 to 6.0), by increasing the X-ray diffraction intensity on {220} crystal plane on the plate surface of the copper alloy plate while maintaining the mean crystal grain size of 3 to 20 μm.

(Finish Cold-Rolling Step)

The finish cold-rolling is carried out in order to improve the strength level of the copper alloy plate. If the rolling reduction in the finish cold-rolling is too low, the strength of the copper alloy plate is low. However, a rolling texture having the {220} orientation as a principal orientation component is developed as the increase of the rolling reduction in the finish cold-rolling. On the other hand, if the rolling reduction in the finish cold rolling is too high, the rolling texture on the {220} orientation is relatively too strong, so that it is not possible to obtain a crystal orientation wherein both of strength and bending workability are improved. For that reason, the rolling reduction in the finish cold-rolling is required to be 30% or less, and it is more preferably 5 to 28% and most preferably 10 to 26%. By carrying out such finish cold-rolling, it is possible to maintain a crystal orientation wherein I{220}/I{420} is in the range of from 2.5 to 8.0. Furthermore, the final thickness of the copper alloy plate is preferably in the range of from about 0.02 mm to about 1.0 mm, more preferably in the range of from 0.05 mm to 0.5 mm and most preferably 0.05 mm to 0.4 mm.

Furthermore, at this finish cold-rolling step, a back tension (a tension applied to a rolled material between an unwinding machine and a pressure roll) is set to be preferably not less than 1 $kg/mm^2$, more preferably not less than 3 $kg/mm^2$ and most preferably not less than 5 $kg/mm^2$, and a forward tension (a tension applied to the rolled material between a winding machine and the pressure roll) is set to be preferably not less than 5 $kg/mm^2$, more preferably not less than 7 $kg/mm^2$ and most preferably not less than 9 $kg/mm^2$. If the tension is thus applied to the rolled material at the finish cold rolling step, it is possible to increase the X-ray diffraction intensity on {220} crystal plane on the plate surface of the copper alloy plate without increasing the rolling reduction.

(Low-Temperature Annealing Step)

After the finish cold rolling, the low-temperature annealing may be carried out in order to improve the stress corrosion cracking resistance and bending workability of the copper alloy plate due to the decrease of the residual stress of the copper alloy plate and in order to improve the stress relaxation resistance of the copper alloy plate due to the decrease of dislocation in vacancies and on the slip plane. In this case, particularly in a Cu—Zn based alloy, it is required to carry out the low-temperature annealing at a temperature of not higher than 500° C. (preferably not higher than 480° C., and the low-temperature annealing is preferably carried out at a heating temperature of 150 to 470° C. (more preferably carried out at a temperature of 300 to 460° C.) (preferably a lower temperature than the annealing temperature at the intermediate-annealing step (and at the final intermediate-annealing step). By this low-temperature annealing, it is possible to improve all of the strength, stress corrosion cracking resistance, bending workability and stress relaxation resistance of the copper alloy plate, and it is also possible to enhance the electric conductivity thereof. If this heating temperature is too high, the copper alloy plate is softened in a short period of time, so that variations in characteristics are easily caused in either of batch and continuous systems. On the other hand, if the heating temperature is too low, it is possible to sufficiently obtain the function of improving the above-described characteristics. The holding time at this heating temperature is preferably 5 seconds or more, and it is possible to usually obtain good results if the holding time is within 1 hour (preferably within 5 minutes).

EXAMPLES

The examples of a copper alloy plate and a method for producing the same according to the present invention will be described below in detail.

Examples 1-24 and Comparative Examples 1-13

There were melted a copper alloy containing 20.00% by weight of zinc, 0.80% by weight of tin, 1.73% by weight of silicon, 0.05% by weight of phosphorus and the balance being copper (Examples 1, 2, 4, 21), a copper alloy containing 20.00% by weight of zinc, 0.78% by weight of tin, 1.76% by weight of silicon, 0.04% by weight of phosphorus and the balance being copper (Example 3), a copper alloy containing 19.70% by weight of zinc, 0.77% by weight of tin, 1.82% by weight of silicon, 0.10% by weight of phosphorus and the balance being copper (Example 5), a copper alloy containing 19.80% by weight of zinc, 0.82% by weight of tin, 1.53% by weight of silicon, 0.20% by weight of phosphorus and the balance being copper (Example 6), a copper alloy containing 19.80% by weight of zinc, 0.79% by weight of tin, 1.05% by weight of silicon, 0.10% by weight of phosphorus and the balance being copper (Example 7), a copper alloy containing 21.00% by weight of zinc, 0.82% by weight of tin, 1.02% by weight of silicon, 0.05% by weight of phosphorus and the balance being copper (Example 8), a copper alloy containing 19.70% by weight of zinc, 2.00% by weight of tin, 1.38% by weight of silicon, 0.04% by weight of phosphorus and the balance being copper (Example 9), a copper alloy containing 30.10% by weight of zinc, 0.76% by weight of tin, 1.84% by weight of silicon, 0.10% by weight of phosphorus and the balance being copper (Example 10), a copper alloy containing 19.70% by weight of zinc, 0.82% by weight of tin, 1.78% by weight of silicon, 0.06% by weight of phosphorus and the balance being copper (Example 11), a copper alloy containing 20.00% by weight of zinc, 0.80% by weight of tin, 1.72% by weight of silicon, 0.05% by weight of phosphorus and the balance being copper (Example 12), a copper alloy containing 20.00% by weight of zinc, 0.80% by weight of tin, 2.21% by weight of silicon, 0.04% by weight of phosphorus and the balance being copper (Example 13), a copper alloy containing 20.00% by weight of zinc, 0.80% by weight of tin, 0.49% by weight of nickel, 1.75% by weight of silicon, 0.05% by weight of phosphorus and the balance being copper (Example 14), a copper alloy containing 20.00% by weight of zinc, 0.80% by weight of tin, 0.49% by weight of nickel, 1.78% by weight of silicon, 0.05% by weight of phosphorus, 0.50% by weight of cobalt and the balance being copper (Example 15), a copper alloy containing 20.00% by weight of zinc, 0.80% by weight of tin, 1.74% by weight of silicon, 0.04% by weight of phosphorus, 0.05% by weight of iron, 0.03% by weight of chromium, 0.08% by weight of manganese and the balance being copper (Example 16), a copper alloy containing 20.00% by weight of zinc, 0.80% by weight of tin, 0.30% by weight of nickel, 1.78% by weight of silicon, 0.06% by weight of phosphorus, 0.06% by weight of manganese, 0.04% by weight of zirconium, 0.10% by weight of titanium, 0.02% by weight of antimony and the balance being copper (Example 17), a copper alloy containing 20.00% by weight of zinc, 0.80% by weight of tin, 1.82% by weight of silicon, 0.05% by weight of phosphorus, 0.08% by weight of aluminum, 0.01% by weight of boron, 0.03% by weight of lead, 0.05% by weight of cadmium and the balance being copper (Example 18), a copper alloy containing 20.00% by weight of zinc, 0.80% by weight of tin, 1.80% by weight of silicon, 0.05% by weight of phosphorus, 0.02% by weight of gold, 0.06% by weight of silver, 0.04% by weight of beryllium, 0.06% by weight of lead and the balance being copper (Example 19), a copper alloy containing 20.00% by weight of zinc, 0.30% by weight of tin, 1.74% by weight of silicon, 0.05% by weight of phosphorus and the balance being copper (Example 20), a copper alloy containing 20.00% by weight of zinc, 0.80% by weight of tin, 1.80% by weight of silicon, 0.05% by weight of phosphorus, 0.03% by weight of tellurium, 0.02% by weight of yttrium, 0.03% by weight of bismuth, 0.06% by weight of arsenic and the balance being copper (Example 22), a copper alloy containing 20.00% by weight of zinc, 0.80% by weight of tin, 1.85% by weight of silicon, 0.08% by weight of phosphorus and the balance being copper (Example 23), a copper alloy containing 20.00% by weight of zinc, 0.77% by weight of tin, 1.94% by weight of silicon, 0.04% by weight of phosphorus and the balance being copper (Example 24), a copper alloy containing 19.80% by weight of zinc, 0.80% by weight of tin, 0.20% by weight of phosphorus and the balance being copper (Comparative Example 1), a copper alloy containing 20.10% by weight of zinc, 0.82% by weight of tin and the balance being copper (Comparative Example 2), a copper alloy containing 20.00% by weight of zinc, 0.79% by weight of tin, 1.80% by weight of silicon and the balance being copper (Comparative Example 3), a copper alloy containing 20.00% by weight of zinc, 0.79% by weight of tin, 0.53% by weight of silicon, 0.05% by weight of phosphorus and the balance being copper (Comparative Example 4), a copper alloy containing 20.00% by weight of zinc, 0.80% by weight of tin, 1.73% by weight of silicon, 0.05% by weight of phosphorus and the balance being copper (Comparative Example 5), a copper alloy containing 19.80% by weight of zinc, 0.78% by weight of tin, 1.86% by weight of silicon, 0.04% by weight of phosphorus and the balance being copper (Comparative Examples 6, 7), a copper alloy containing 20.00% by weight of zinc, 0.80% by weight of tin, 1.04% by weight of silicon, 0.02% by weight of phosphorus and the balance being copper (Comparative Example 8), a copper alloy containing 20.00% by weight of zinc, 0.80% by weight of tin, 1.78% by weight of silicon, 0.04% by weight of phosphorus and the balance being copper (Comparative Example 9), a copper alloy containing 20.00% by weight of zinc, 0.80% by weight of tin, 1.90% by weight of silicon, 0.10% by weight of phosphorus and the balance being copper (Comparative Example 10), a copper alloy containing 20.00% by weight of zinc, 1.75% by weight of silicon, 0.05% by weight of phosphorus and the balance being copper (Comparative Example 11), and a copper alloy containing 9.90% by weight of zinc, 0.47% by weight of tin, 1.77% by weight of silicon, 0.03% by weight of phosphorus, 0.09% by weight of cobalt, 0.05% by weight of antimony and the balance being copper (Comparative Examples 12, 13), respectively. Then, the melted copper alloys were cast to obtain ingots, and cast pieces having a size of 300 mm×1000 mm×200 mm (Examples 1-24, Comparative Examples 1-5), a size of 300 mm×1000 mm×100 mm (Comparative Examples 6-9), a size of 300 mm×1000 mm×160 mm (Comparative Examples 10-11) and a size of 300 mm×1000 mm×35 mm (Comparative Examples 12-13) were cut out from the ingots, respectively. Furthermore, the total (6P+Si) of the content of silicon (Si) and six times (6P) as much as the content of phosphorus (P) in each of the copper alloys was 2.03% by weight (Examples 1, 2, 4, 21), 2.00% by weight (Example 3), 2.42% by weight (Example 5), 2.73% by weight (Example 6), 1.65% by weight (Example 7), 1.30% by weight (Example 8), 1.62% by weight (Example 9), 2.44% by weight (Example 10), 2.14% by weight (Example 11), 2.02% by weight (Example 12, Comparative Example 9), 2.45% by weight (Example 13), 2.05% by weight (Example 14), 2.08% by weight (Example 15), 1.98% by weight (Example 16), 2.14% by weight (Example 17), 2.12% by weight (Example 18), 2.10% by weight (Examples 19, 22, Comparative Examples 6, 7), 2.04% by weight (Example 20), 2.33% by weight (Example 23), 2.18% by weight (Example 24), 1.20% by weight (Comparative Example 1), 0% by weight (Comparative Example 2), 1.80% by weight (Comparative Example 3), 0.83% by weight (Comparative Example 4), 2.03% by weight (Comparative Example 5), 1.16% by weight (Comparative Example 8), 2.50% by weight (Comparative Example 10), 2.05% by weight (Comparative Example 11), and 1.95% by weight (Comparative Examples 12, 13), respectively.

After each of the cast pieces was heated at 700° C. (Examples 1-4, 7, 8, 11-13, 14, 16-24, Comparative Examples 1, 3-7, 9-11), at 675° C. (Examples 5, 9, 10, 15), at 660° C. (Example 6), at 800° C. (Comparative Example 2), at 750° C. (Comparative Example 8) and at 780° C. (Comparative Examples 12, 13), respectively, for 300 minutes, it was hot-rolled in a temperature range of 900° C. to 300° C. at a total rolling reduction of 92% (Examples 1-10, 14, 16-24, Comparative Examples 1-5), at a total rolling reduction of 94% (Examples 11-13, 15) and at a total rolling reduction of 90% (Comparative Examples 6-11), respectively. In a temperature range from 650° C. to 300° C. in the temperature range of from 900° C. to 300° C., the hot-rolling was carried out at a rolling reduction of 15% (Examples 1-24, Comparative Examples 1-9, 11) and at a rolling reduction of 5% (Comparative Example 10), respectively, to cause the cast pieces to have a thickness of 16.00 mm (Examples 1-10, 14, 16, 21-24, Comparative Examples 1-5, 10, 11), 12.00 mm (Examples 11-13, 15), 17.00 mm (Examples 17-20) and 10.00 mm (Comparative Examples 6-9), respectively. Furthermore, in Comparative Examples 12 and 13, the hot-rolling was carried out in the temperature range of 900° C. to 300° C. (at a total rolling reduction of 83%, at a rolling reduction of 0% in the temperature range of from 650° C. to 300° C.) so that the thickness of the plate was changed from 35 mm to 6 mm by four passes.

Then, each of the pieces was first cold-rolled at a total rolling reduction of 94% so as to have a thickness of 0.90 mm (Examples 1-10, 14, 16, 21-24, Comparative Examples 1-5, 11), at a total rolling reduction of 95% so as to have a thickness of 0.90 mm (Examples 17-20), at a total rolling reduction of 90% so as to have a thickness of 1.2 mm (Example 11), at a total rolling reduction of 93% so as to have a thickness of 0.90 mm (Examples 12, 13, 15), at a total rolling reduction of 84% so as to have a thickness of 1.6 mm (Comparative Examples 6-9), at a total rolling reduction of 90% so as to have a thickness of 1.6 mm (Comparative Example 10), at a total rolling reduction of 83% so as to have a thickness of 1.00 mm (Comparative Examples 12, 13), respectively. Furthermore, in Examples 1-24 and Comparative Examples 1-11, the first cold-rolling was carried out by three cold-rolling passes, and annealing operations (two annealing operations) were carried out between the cold-rolling passes, respectively. As the annealing operations between the cold-rolling passes, there were carried out two annealing operations for holding the pieces at 500° C. for 5 hours (Examples 1-3, 5, 6, 8-14, 16, 17, 20-24, Comparative Examples 1, 3-11), at 525° C. for 5 hours (Examples 4, 15, 18, Comparative Example 2) and at 550° C. for 5 hours (Examples 7, 19), respectively.

Then, there was carried out the intermediate-annealing for holding each of the pieces at 500° C. (Examples, 1-3, 5, 6, 8-14, 16, 17, 20-24, Comparative Examples 1, 3-11), at 525° C. (Examples 4, 15, 18, Comparative Example 2) and at 550° C. (Examples 7, 19), respectively, for 5 hours. Furthermore, in Comparative Examples 12 and 13, this intermediate-annealing was not carried out.

Then, each of the pieces was second cold-rolled at a rolling reduction of 58% so as to have a thickness of 0.38 mm (Examples 1, 4, 6, 12, 14, Comparative Examples 3, 4, 11), at a rolling reduction of 60% so as to have a thickness of 0.36 mm (Examples 2, 5, 10, 13, 15, 16-20, 22), at a rolling reduction of 57% so as to have a thickness of 0.39 mm (Example 3), at a rolling reduction of 56% so as to have a thickness of 0.40 mm (Examples 7, 8), at a rolling reduction of 63% so as to have a thickness of 0.33 mm (Examples 9, 23, 24, Comparative Example 5), at a rolling reduction of 69% so as to have a thickness of 0.37 mm (Example 11), at a rolling reduction of 62% so as to have a thickness of 0.34 mm (Example 21), at a rolling reduction of 50% so as to have a thickness of 0.45 mm (Comparative Examples 1, 2), at a rolling reduction of 78% so as to have a thickness of 0.36 mm (Comparative Example 6), at a rolling reduction of 76% so as to have a thickness of 0.38 mm (Comparative Example 7), at a rolling reduction of 74% so as to have a thickness of 0.41 mm (Comparative Example 8), at a rolling reduction of 75% so as to have a thickness of 0.40 mm (Comparative Example 9) and at a rolling reduction of 78% so as to have a thickness of 0.35 mm (Comparative Example 10), respectively. Furthermore, in Comparative Examples 12 and 13, this second cold-rolling was not carried out.

Then, a continuous annealing furnace was used for carrying out the (final) intermediate-annealing for holding each of the pieces at 670° C. for 21 seconds (Examples 1, 3, 5, 6, 8, 11, 16, 18, 20, Comparative Example 3), at 670° C. for 18 seconds (Example 2), at 670° C. for 19 seconds (Example 4), at 650° C. for 32 seconds (Example 7, Comparative Example 4), at 700° C. for 24 seconds (Example 9), at 720° C. for 12 seconds (Example 10), at 700° C. for 32 seconds (Example 12), at 700° C. for 18 seconds (Example 13), at 680° C. for 21 seconds (Example 14), at 700° C. for 21 seconds (Example 15), at 670° C. for 25 seconds (Example 17, Comparative Examples 1, 2), at 685° C. for 21 seconds (Example 19), at 610° C. for 21 seconds (Example 21), at 670° C. for 30 seconds (Example 22), at 560° C. for 25 seconds (Example 23), at 685° C. for 25 seconds (Example 24), at 530° C. for 21 seconds (Comparative Example 5), at 500° C. for 10 minutes (Comparative Examples 6-8), at 600° C. for 10 minutes (Comparative Example 9), at 350° C. for 10 minutes (Comparative Example 10), at 600° C. for 21 seconds (Comparative Example 11), at 400° C. for 60 minutes (Comparative Example 12) and at 500° C. for 20 seconds (Comparative Example 13), respectively.

Then, each of the pieces was finish cold-rolled at a rolling reduction of 20% (Examples 1, 4, 6, 12, 14, Comparative Examples 3, 4, 6), at a rolling reduction of 16% (Examples 2, 5, 10, 13, 15-20, 22-24, Comparative Examples 7, 11), at a rolling reduction of 23% (Example 3), at a rolling reduction of 25% (Examples 7, 8, Comparative Example 9), at a rolling reduction of 10% (Example 9, Comparative Example 5), at a rolling reduction of 18% (Example 11), at a rolling reduction of 12% (Example 21), at a rolling reduction of 33% (Comparative Examples 1, 2), at a rolling reduction of 27% (Comparative Example 8), at a rolling reduction of 15% (Comparative Example 10), respectively, so as to have a thickness of about 0.3 mm (0.28 to 0.32 mm). In this finish cold-rolling, the back tension and the forward tension were set to be 6.9 kg/mm$^2$ and 15.0 kg/mm$^2$ (Examples 1-3, 6, 8, 13, 21, 24, Comparative Examples 3, 4), 7.5 kg/mm$^2$ and 16.6 kg/mm$^2$ (Example 4, Comparative Example 5), 6.2 kg/mm$^2$ and 13.6 kg/mm$^2$ (Examples 5, 16, 22), 5.5 kg/mm$^2$ and 10.2 kg/mm$^2$ (Examples 7, 14, 20, Comparative Examples 1, 2, 11), 1.6 kg/mm$^2$ and 5.7 kg/mm$^2$ (Example 9), 3.2 kg/mm$^2$ and 8.3 kg/mm$^2$ (Example 10), 2.6 kg/mm$^2$ and 7.4 kg/mm$^2$ (Examples 11, 12), 4.0 kg/mm$^2$ and 9.1 kg/mm$^2$ (Examples 15, 17, 18), 6.0 kg/mm$^2$ and 13.6 kg/mm$^2$ (Example 19), 1.2 kg/mm$^2$ and 5.2 kg/mm$^2$ (Example 23), and 0 kg/mm$^2$ and 0 kg/mm$^2$ (Comparative Examples 6-10), respectively. Furthermore, in Comparative Examples 12 and 13, this finish cold-rolling was not carried out.

Then, a batch annealing furnace was used for carrying out the low-temperature annealing for holding each of the pieces at 450° C. for 23 seconds (Examples 1-8, 10-24, Comparative Examples 1-4, 11), at 480° C. for 23 seconds (Example 9), at 400° C. for 23 seconds (Comparative Example 5), at 350° C. for 30 minutes (Comparative Examples 6, 7, 9) and at 300° C. for 30 minutes (Comparative Examples 8, 10), respectively. Furthermore, in Comparative Examples 12 and 13, this low-temperature annealing was not carried out.

Then, samples were cut out from the copper alloy plates thus obtained in Examples 1-24 and Comparative Examples 1-13, and the mean crystal grain size, X-ray diffraction intensity, electric conductivity, 0.2% proof stress, tensile strength, elongation, stress relaxation resistance, stress corrosion cracking resistance and bending workability thereof were examined as follows.

The mean crystal grain size of crystal grain structure of the copper alloy plate was measured by the method of section based on JIS H0501 by observing the surface (rolled surface) of the copper alloy plate by means of an optical microscope after the surface was polished and etched. As a result, the mean crystal grain size was 8 μm (Examples 1-4, Comparative Example 4), 11 μm (Examples 5, 13, 19, Comparative Example 1), 10 μm (Examples 6, 9-11, 14, 17, 18, 20, Comparative Examples 2, 6, 8, 11), 12 μm (Examples 7, 22), 9 μm (Examples 8, 15, 16, Comparative Examples 3, 7), 16 μm (Example 12), 6 μm (Example 21), 5 μm (Example 23), 14 μm (Example 24), 2 μm (Comparative Examples 5, 10, 13), 15 μm (Comparative Example 9), and 1.3 μm (Comparative Example 12), respectively.

The measurement of the intensity of X-ray diffraction (the integrated intensity of X-ray diffraction) was carried out by measuring the integrated intensity I{220} of the diffraction peak on {220} plate and the integrated intensity I{420} of the diffraction peak on {420} plane with respect to the surface (rolled surface) of the sample by means of an X-ray diffractometer (XRD) (RINT 2000 produced by Rigaku Corporation) using a Cu tube on conditions containing a tube voltage of 40 kV and a tube current of 20 mA. These measured values were used for obtaining the X-ray diffraction intensity ratio I{220}/I{420}. As a result, the X-ray diffraction intensity ratio I{220}/I{420} was 4.19 (Example 1), 4.15 (Example 2), 5.13 (Example 3), 4.21 (Example 4), 4.43 (Example 5), 4.22 (Example 6), 4.90 (Example 7), 4.70 (Example 8), 3.65 (Example 9), 3.89 (Example 10), 3.34 (Example 11), 3.66 (Example 12), 4.92 (Example 13), 4.32 (Example 14), 3.98 (Examples 15, 17), 4.28 (Example 16), 4.01 (Example 18), 4.22 (Examples 19, 22), 3.60 (Example 20), 4.72 (Example 21), 2.52 (Example 23), 2.82 (Example 24), 2.60 (Comparative Example 1), 3.76 (Comparative Example 2), 3.59 (Comparative Example 3), 4.30 (Comparative Example 4), 8.50 (Comparative Example 5), 1.82 (Comparative Example 6), 1.78 (Comparative Example 7), 1.90 (Comparative Example 8), 1.72 (Comparative Example 9), 2.40 (Comparative Example 10), 3.56 (Comparative Example 11), 2.10 (Comparative Example 12), and 2.40 (Comparative Example 13), respectively.

The electric conductivity of the copper alloy plate was measured in accordance with the electric conductivity measuring method based on JIS H0505. As a result, the electric conductivity of the copper alloy plate was 10.3% IACS (Example 1, Comparative Example 7), 10.2% IACS (Examples 2, 12, 16), 9.8% IACS (Examples 3, 17, Comparative Examples 5, 11), 10.0% IACS (Examples 4, 14), 9.6% IACS (Examples 5, 18, 21, Comparative Example 9), 9.7% IACS (Examples 6, 15, 24), 13.0% IACS (Example 7), 13.2% IACS (Example 8), 8.6% IACS (Example 9), 8.7% IACS (Example 10), 9.9% IACS (Examples 11, 20, 23), 9.3% IACS (Example 13), 10.5% IACS (Example 19), 10.1% IACS (Example 22, Comparative Examples 4, 6), 24.1% IACS (Comparative Example 1), 9.0% IACS (Comparative Example 10), 25.5% IACS (Comparative Example 2), 11.0% IACS (Comparative Example 3), 14.2% IACS (Comparative Example 8), 12.0% IACS (Comparative Example 12), and 11.5% IACS (Comparative Example 13), respectively.

In order to evaluate mechanical characteristics of the copper alloy plate, a test piece LD (No. 5 test piece based on JIS 22201) for tension test was cut out from the copper alloy, the longitudinal directions of the test piece LD being directions LD (rolling directions of the copper alloy plate) while the width directions of the test piece LD being directions TD (directions perpendicular to the rolling and thickness directions of the copper alloy plate), and a test piece TD (No. 5 test piece based on JIS 22201) for tension test was cut out from the copper alloy, the longitudinal directions of the test piece TD being directions TD while the width directions of the test piece TD being directions LD. With respect to each of the test pieces LD and TD, a tension test based on JIS 22241 was carried out to derive the 0.2% proof stress, tensile strength and breaking elongation thereof and to derive the ratio (TD/LD) of the 0.2% proof stress and the ratio (TD/LD) of the tensile strength.

As a result, the 0.2% proof stress of each of the test pieces LD and TD of the copper alloy plate, and the ratio (TD/LD) thereof were 610 MPa, 664 MPa and 1.09 (Example 1), 557 MPa, 589 MPa and 1.06 (Example 2), 625 MPa, 670 MPa and 1.07 (Example 3), 581 MPa, 615 MPa and 1.06 (Example 4), 588 MPa, 629 MPa and 1.07 (Example 5), 589 MPa, 622 MPa and 1.06 (Example 6), 572 MPa, 611 MPa and 1.07 (Example 7), 569 MPa, 601 MPa and 1.06 (Example 8), 591 MPa, 644 MPa and 1.09 (Example 9), 576 MPa, 609 MPa and 1.06 (Example 10), 572 MPa, 606 MPa and 1.06 (Example 11), 564 MPa, 602 MPa and 1.07 (Example 12), 569 MPa, 630 MPa and 1.11 (Example 13), 546 MPa, 599 MPa and 1.10 (Example 14), 567 MPa, 604 MPa and 1.07 (Example 15), 564 MPa, 600 MPa and 1.06 (Example 16), 569 MPa, 599 MPa and 1.05 (Example 17), 551 MPa, 590 MPa and 1.07 (Example 18), 571 MPa, 604 MPa and 1.06 (Example 19), 565 MPa, 602 MPa and 1.07 (Example 20), 615 MPa, 669 MPa and 1.09 (Example 21), 571 MPa, 605 MPa and 1.06 (Example 22), 558 MPa, 589 MPa and 1.06 (Example 23), 474 MPa, 500 MPa and 1.05 (Example 24), 561 MPa, 595 MPa and 1.06 (Comparative Example 1), 562 MPa, 592 MPa and 1.05 (Comparative Example 2), 560 MPa, 595 MPa and 1.06 (Comparative Example 3), 532 MPa, 578 MPa and 1.09 (Comparative Example 4), 650 MPa, 698 MPa and 1.07 (Comparative Example 5), 524 MPa, 536 MPa and 1.02 (Comparative Example 6), 531 MPa, 542 MPa and 1.02 (Comparative Example 7), 576 MPa, 587 MPa and 1.02 (Comparative Example 8), 535 MPa, 545 MPa and 1.02 (Comparative Example 9), 520 MPa, 533 MPa and 1.03 (Comparative Example 10), 487 MPa, 537 MPa and 1.10 (Comparative Example 11), 708 MPa, 755 MPa and 1.07 (Comparative Example 12), and 730 MPa, 775 MPa and 1.06 (Comparative Example 13), respectively.

The tensile strength of each of the test pieces LD and TD of the copper alloy plate, and the ratio (TD/LD) thereof were 678 MPa, 731 MPa and 1.08 (Example 1), 641 MPa, 683 MPa and 1.07 (Example 2), 699 MPa, 741 MPa and 1.06 (Example 3), 660 MPa, 701 MPa and 1.06 (Example 4), 648 MPa, 690 MPa, 1.06 (Example 5), 661 MPa, 707 MPa and 1.07 (Example 6), 645 MPa, 691 MPa and 1.07 (Example 7), 648 MPa, 688 MPa and 1.06 (Example 8), 655 MPa, 700 MPa and 1.07 (Example 9), 642 MPa, 678 MPa and 1.06 (Example 10), 645 MPa, 681 MPa and 1.06 (Example 11), 637 MPa, 679 MPa and 1.07 (Example 12), 648 MPa, 701 MPa and 1.08 (Example 13), 651 MPa, 696 MPa and 1.07 (Example 14), 644 MPa, 686 MPa and 1.07 (Example 15), 647 MPa, 691 MPa and 1.07 (Example 16), 642 MPa, 692 MPa and 1.08 (Example 17), 637 MPa, 688 MPa and 1.08 (Example 18), 648 MPa, 691 MPa and 1.07 (Example 19), 647 MPa, 691 MPa and 1.07 (Example 20), 684 MPa, 732 MPa and 1.07 (Example 21), 644 MPa, 688 MPa and 1.07 (Example 22), 639 MPa, 675 MPa and 1.06 (Example 23), 565 MPa, 595 MPa and 1.05 (Example 24), 639 MPa, 688 MPa and 1.08 (Comparative Example 1), 635 MPa, 681 MPa and 1.07 (Comparative Example 2), 638 MPa, 683 MPa and 1.07 (Comparative Example 3), 626 MPa, 667 MPa and 1.07 (Comparative Example 4), 711 MPa, 766 MPa and 1.08 (Comparative Example 5), 639 MPa, 655 MPa and 1.03 (Comparative Example 6), 640 MPa, 659 MPa and 1.03 (Comparative Example 7), 620 MPa, 641 MPa and 1.03 (Comparative Example 8), 610 MPa, 631 MPa and 1.03 (Comparative Example 9), 639 MPa, 650 MPa and 1.02 (Comparative Example 10), 623 MPa, 669 MPa and 1.07 (Comparative Example 11), 795 MPa, 848 MPa and 1.07 (Comparative Example 12), and 815 MPa, 868 MPa and 1.07 (Comparative Example 13), respectively.

The breaking elongation of each of the test pieces LD and TD of the copper alloy plate was 22.2% and 12.7% (Example 1), 27.4% and 19.5% (Example 2), 18.6% and 10.2% (Example 3), 26.9% and 17.3% (Example 4), 21.7% and 16.2% (Example 5), 21.8% and 15.9% (Example 6), 25.4% and 17.6% (Example 7), 24.9% and 16.5% (Example 8), 23.1% and 15.2% (Example 9), 22.4% and 13.6% (Example 10), 28.9% and 18.7% (Example 11), 25.4% and 16.0% (Example 12), 25.8% and 15.1% (Example 13), 26.0% and 15.3% (Example 14), 26.2% and 15.8% (Example 15), 27.2% and 18.3% (Example 16), 28.5% and 19.4% (Example 17), 30.1% and 18.8% (Example 18), 29.0% and 17.2% (Example 19), 25.2% and 15.3 (Example 20), 19.4% and 12.1% (Example 21), 28.1% and 16.7% (Example 22), 30.1% and 17.4% (Example 23), 34.4% and 27.2% (Example 24), 16.4% and 7.4% (Comparative Example 1), 14.2% and 6.8% (Comparative Example 2), 29.8% and 15.3% (Comparative Example 3), 24.3% and 13.8% (Comparative Example 4), 26.7% and 14.1% (Comparative Example 5), 33.7% and 19.9% (Comparative Example 6), 32.6% and 17.8% (Comparative Example 7), 16.4% and 6.8% (Comparative Example 8), 17.2% and 7.3% (Comparative Example 9), 26.2% and 18.7% (Comparative Example 10), 27.7% and 19.4% (Comparative Example 11), 10.0% and 4.2% (Comparative Example 12), and 10.3% and 4.1% (Comparative Example 13), respectively.

The stress relaxation resistance of the copper alloy plate was evaluated by the cantilever block type stress relaxation test prescribed in JEITA EMAS-1011. Specifically, a test piece LD (having a length of 60 mm×a width of 10 mm) was cut out from the copper alloy plate so that the longitudinal directions of the test piece were directions LD (rolling directions of the copper alloy plate) while the width directions thereof were directions TD (directions perpendicular to the rolling and thickness directions of the copper alloy plate). One end portion of the test piece in longitudinal directions thereof was fixed to (a test-piece holding block of)

a cantilever block type deflection loading jig, and the other end portion (free end portion) of the test piece in longitudinal directions thereof was fixed in a state that a load stress corresponding to 80% of the 0.2% proof stress thereof was applied on the other end portion thereof (by means of a deflection adjusting block and a wedge-shaped block) so that the thickness directions of the test piece were deflection directions. After this test piece was held at 150° C. for 1000 hours, the deflection of the test piece was measured. From the rate of variability in the deflection, a stress relaxation rate (%) was calculated to evaluate the stress relaxation resistance of the copper alloy plate. As a result, the stress relaxation rate of the test piece LD was 28% (Example 1), 20% (Examples 2, 6, Comparative Example 11), 24% (Examples 3, 10, 19, Comparative Example 3), 23% (Examples 4, 11, 16), 21% (Examples 5, 17, 20), 27% (Example 7), 26% (Examples 8, 14, Comparative Example 7), 22% (Examples 9, 18), 31% (Example 12), 25% (Examples 13, 15, 22), 32% (Example 21), 28% (Example 23), 17% (Example 24), 40% (Comparative Examples 1, 10), 41% (Comparative Example 2), 29% (Comparative Example 4), 45% (Comparative Example 5), 33% (Comparative Examples 6, 9), 37% (Comparative Example 8), 48% (Comparative Example 12) and 44% (Comparative Example 13), respectively.

In order to evaluate the stress corrosion cracking resistance of the copper alloy plate, a test piece (having a width of 10 mm) cut out from the copper alloy plate was bent in the form of an arch so that the surface stress in the central portion of the test piece in the longitudinal directions thereof was 80% of the 0.2% yield stress thereof. In this state, the test piece was held at 25° C. in a desiccator containing 3% by weight of ammonia water. With respect to the test piece taken out every one hour, cracks were observed at a magnification of 100 by means of an optical microscope to evaluate the stress corrosion cracking resistance. As a result, cracks were observed after 144 hours (Example 1), 170 hours (Example 2), 168 hours (Example 3), 141 hours (Example 4), 201 hours (Example 5), 240 hours (Example 6), 155 hours (Example 7), 125 hours (Example 8), 171 hours (Example 9), 110 hours (Example 10), 149 hours (Example 11), 138 hours (Example 12), 182 hours (Example 13), 122 hours (Example 14), 169 hours (Example 15), 168 hours (Example 16), 186 hours (Example 17), 182 hours (Example 18), 174 hours (Example 19), 112 hours (Example 20), 184 hours (Example 21), 197 hours (Example 22), 194 hours (Example 23), 192 hours (Example 24), 40 hours (Comparative Example 1), 8 hours (Comparative Example 2), 84 hours (Comparative Example 3), 92 hours (Comparative Example 4), 171 hours (Comparative Example 5), 165 hours (Comparative Example 6), 199 hours (Comparative Example 7), 135 hours (Comparative Example 8), 189 hours (Comparative Example 9), 180 hours (Comparative Example 10), 75 hours (Comparative Example 11), 166 hours (Comparative Example 12), and 182 hours (Comparative Example 13), respectively. The time when cracks were observed in the copper alloy plate was 29 times (Example 1), 34 times (Example 2), 34 times (Example 3), 28 times (Example 4), 40 times (Example 5), 48 times (Example 6), 31 times (Example 7), 25 times (Example 8), 34 times (Example 9), 22 times (Example 10), 30 times (Example 11), 28 times (Example 12), 36 times (Example 13), 24 times (Example 14), 34 times (Example 15), 34 times (Example 16), 37 times (Example 17), 36 times (Example 18), 35 times (Example 19), 22 times (Example 20), 37 times (Example 21), 39 times (Example 22), 39 times (Example 23), 38 times (Example 24), 8 times (Comparative Example 1), 1.6 times (Comparative Example 2), 17 times (Comparative Example 3), 18 times (Comparative Example 4), 34 times (Comparative Example 5), 33 times (Comparative Example 6), 40 times (Comparative Example 7), 27 times (Comparative Example 8), 38 times (Comparative Example 9), 36 times (Comparative Example 10), 15 times (Comparative Example 11), 33 times (Comparative Example 12) and 36 times (Comparative Example 13), respectively, as long as the time (5 hours) in a plate of a commercially-available first-class brass (C2600-SH).

In order to evaluate the bending workability of the copper alloy plate, a bending test piece LD (having a width of 10 mm) was cut out from the copper alloy plate so that the longitudinal directions of the test piece were directions LD (rolling directions of the copper alloy plate) while the width directions of the test piece were directions TD (directions perpendicular to the rolling and thickness directions of the copper alloy plate), and a bending test piece TD (having a width of 10 mm) was cut out from the copper alloy plate so that the longitudinal directions of the test piece were directions TD while the width directions of the test piece were directions LD. Then, with respect to the bending test piece LD, the W bending test based on JIS H3130 was carried out so that the bending axis of the bending test piece extended in directions TD (Goodway bending (G.W. bending)). In addition, with respect to the bending test piece TD, the W bending test based on JIS H3130 was carried out so that the bending axis of the bending test piece extended in directions LD (BadWay bending (B.W. bending)). With respect to each of the bending test pieces after this test, the surface and cross-section of the bent portion thereof were observed at a magnification of 100 by means of an optical microscope to obtain a minimum bending radius R (mm) wherein cracks were not observed. Then, the minimum bending radius R was divided by the thickness t (mm) to derive the ratio R/t of each of the bending test pieces and the ratio (LD/TD) thereof. As a result, the ratios R/t of the bending test pieces LD and Td and the ratio LD/TD thereof were 0.3, 0.7, 0.43 (Examples 1, 21), 0.3, 0.3, 1.00 (Examples 2, 4, 5, 8, 9, 11-20, 22-24, Comparative Examples 3, 6-8, 11), 0.3, 1.7, 0.18 (Example 3), 0.3, 0.6, 0.50 (Examples 6, 7, 10, Comparative Examples 4, 9, 10), 1.2, 2.0, 0.60 (Comparative Examples 1, 12, 13), 1.2, 2.7, 0.44 (Comparative Example 2), and 1.2, 1.2, 1.00 (Comparative Example 5), respectively.

The producing conditions and characteristics of the copper alloy plates in these examples and comparative examples are shown in Tables 1 through 12.

TABLE 1

| | Chemical Composition (% by weight) | | | | | | |
|---|---|---|---|---|---|---|---|
| | Cu | Zn | Sn | Si | P | Other elements | 6P + Si |
| Ex. 1 | bal. | 20.0 | 0.80 | 1.73 | 0.05 | | 2.03 |
| Ex. 2 | bal. | 20.0 | 0.80 | 1.73 | 0.05 | | 2.03 |
| Ex. 3 | bal. | 20.0 | 0.78 | 1.76 | 0.04 | | 2.00 |
| Ex. 4 | bal. | 20.0 | 0.80 | 1.73 | 0.05 | | 2.03 |
| Ex. 5 | bal. | 19.7 | 0.77 | 1.82 | 0.10 | | 2.42 |
| Ex. 6 | bal. | 19.8 | 0.82 | 1.53 | 0.20 | | 2.73 |
| Ex. 7 | bal. | 19.8 | 0.79 | 1.05 | 0.10 | | 1.65 |
| Ex. 8 | bal. | 21.0 | 0.82 | 1.02 | 0.05 | | 1.30 |
| Ex. 9 | bal. | 19.7 | 2.00 | 1.38 | 0.04 | | 1.62 |
| Ex. 10 | bal. | 30.1 | 0.76 | 1.84 | 0.10 | | 2.44 |
| Ex. 11 | bal. | 19.7 | 0.82 | 1.78 | 0.06 | | 2.14 |
| Ex. 12 | bal. | 20.0 | 0.80 | 1.72 | 0.05 | | 2.02 |
| Ex. 13 | bal. | 20.0 | 0.80 | 2.21 | 0.04 | | 2.45 |
| Ex. 14 | bal. | 20.0 | 0.80 | 1.75 | 0.05 | Ni0.49 | 2.05 |

TABLE 1-continued

| | Chemical Composition (% by weight) | | | | | | |
|---|---|---|---|---|---|---|---|
| | Cu | Zn | Sn | Si | P | Other elements | 6P + Si |
| Ex. 15 | bal. | 20.0 | 0.80 | 1.78 | 0.05 | Ni0.49<br>Co0.50 | 2.08 |
| Ex. 16 | bal. | 20.0 | 0.80 | 1.74 | 0.04 | Fe0.05<br>Cr0.03<br>Mn0.08 | 1.98 |
| Ex. 17 | bal. | 20.0 | 0.80 | 1.78 | 0.06 | Ni0.30<br>Mg0.06<br>Zr0.04<br>Ti0.10<br>Sb0.02 | 2.14 |
| Ex. 18 | bal. | 20.0 | 0.80 | 1.82 | 0.05 | Al0.08<br>B0.01<br>Pb0.03<br>Cd0.05 | 2.12 |
| Ex. 19 | bal. | 20.0 | 0.80 | 1.80 | 0.05 | Au0.02<br>Ag 0.06<br>Be0.04<br>Pb0.06 | 2.10 |
| Ex. 20 | bal. | 20.0 | 0.30 | 1.74 | 0.05 | | 2.04 |
| Ex. 21 | bal. | 20.0 | 0.80 | 1.73 | 0.05 | | 2.03 |
| Ex. 22 | bal. | 20.0 | 0.80 | 1.80 | 0.05 | Te0.03<br>Y0.02<br>Bi0.03<br>As0.06 | 2.10 |
| Ex. 23 | bal. | 20.0 | 0.80 | 1.85 | 0.08 | | 2.33 |
| Ex. 24 | bal. | 20.0 | 0.77 | 1.94 | 0.04 | | 2.18 |

TABLE 2

| | Chemical Composition (% by weight) | | | | | | |
|---|---|---|---|---|---|---|---|
| | Cu | Zn | Sn | Si | P | Other Elements | 6P + Si |
| Comp. 1 | bal. | 19.8 | 0.80 | 0 | 0.20 | | 1.20 |
| Comp. 2 | bal. | 20.1 | 0.82 | 0 | 0 | | 0 |
| Comp. 3 | bal. | 20.0 | 0.79 | 1.80 | 0 | | 1.80 |
| Comp. 4 | bal. | 20.0 | 0.79 | 0.53 | 0.05 | | 0.83 |
| Comp. 5 | bal. | 20.0 | 0.80 | 1.73 | 0.05 | | 2.03 |
| Comp. 6 | bal. | 19.8 | 0.78 | 1.86 | 0.04 | | 2.10 |
| Comp. 7 | bal. | 19.8 | 0.78 | 1.86 | 0.04 | | 2.10 |
| Comp. 8 | bal. | 20.0 | 0.80 | 1.04 | 0.02 | | 1.16 |
| Comp. 9 | bal. | 20.0 | 0.80 | 1.78 | 0.04 | | 2.02 |
| Comp. 10 | bal. | 20.0 | 0.80 | 1.90 | 0.10 | | 2.50 |
| Comp. 11 | bal. | 20.0 | 0 | 1.75 | 0.05 | | 2.05 |
| Comp. 12 | bal. | 9.9 | 0.47 | 1.77 | 0.03 | Co0.09<br>Sb0.05 | 1.95 |
| Comp. 13 | bal. | 9.9 | 0.47 | 1.77 | 0.03 | Co0.09<br>Sb0.05 | 1.95 |

TABLE 3

| | | Hot Rolling | | | |
|---|---|---|---|---|---|
| | Heating Temp. (° C.) | Total Rolling Reduction (%) | Rolling Reduction (%) at 650° C. or lower | Total Rolling Reduction (%) in First Cold Rolling | Temp. (° C.) in Intermediate Annealing |
| Ex. 1 | 700 | 92 | 15 | 94 | 500 |
| Ex. 2 | 700 | 92 | 15 | 94 | 500 |
| Ex. 3 | 700 | 92 | 15 | 94 | 500 |
| Ex. 4 | 700 | 92 | 15 | 94 | 525 |
| Ex. 5 | 675 | 92 | 15 | 94 | 500 |
| Ex. 6 | 660 | 92 | 15 | 94 | 500 |
| Ex. 7 | 700 | 92 | 15 | 94 | 550 |
| Ex. 8 | 700 | 92 | 15 | 94 | 500 |

TABLE 3-continued

| | | Hot Rolling | | | |
|---|---|---|---|---|---|
| | Heating Temp. (° C.) | Total Rolling Reduction (%) | Rolling Reduction (%) at 650° C. or lower | Total Rolling Reduction (%) in First Cold Rolling | Temp. (° C.) in Intermediate Annealing |
| Ex. 9 | 675 | 92 | 15 | 94 | 500 |
| Ex. 10 | 675 | 92 | 15 | 94 | 500 |
| Ex. 11 | 700 | 94 | 15 | 90 | 500 |
| Ex. 12 | 700 | 94 | 15 | 93 | 500 |
| Ex. 13 | 700 | 94 | 15 | 93 | 500 |
| Ex. 14 | 700 | 92 | 15 | 94 | 500 |
| Ex. 15 | 675 | 94 | 15 | 93 | 525 |
| Ex. 16 | 700 | 92 | 15 | 94 | 500 |
| Ex. 17 | 700 | 92 | 15 | 95 | 500 |
| Ex. 18 | 700 | 92 | 15 | 95 | 525 |
| Ex. 19 | 700 | 92 | 15 | 95 | 550 |
| Ex. 20 | 700 | 92 | 15 | 95 | 500 |
| Ex. 21 | 700 | 92 | 15 | 94 | 500 |
| Ex. 22 | 700 | 92 | 15 | 94 | 500 |
| Ex. 23 | 700 | 92 | 15 | 94 | 500 |
| Ex. 24 | 700 | 92 | 15 | 94 | 500 |

TABLE 4

| | | Hot Rolling | | | |
|---|---|---|---|---|---|
| | Heating Temp. (° C.) | Total Rolling Reduction (%) | Rolling Reduction (%) at 650° C. or lower | Total Rolling Reduction (%) in First Cold Rolling | Temp. (° C.) in Intermediate Annealing |
| Comp. 1 | 700 | 92 | 15 | 94 | 500 |
| Comp. 2 | 800 | 92 | 15 | 94 | 525 |
| Comp. 3 | 700 | 92 | 15 | 94 | 500 |
| Comp. 4 | 700 | 92 | 15 | 94 | 500 |
| Comp. 5 | 700 | 92 | 15 | 94 | 500 |
| Comp. 6 | 700 | 90 | 15 | 84 | 500 |
| Comp. 7 | 700 | 90 | 15 | 84 | 500 |
| Comp. 8 | 750 | 90 | 15 | 84 | 500 |
| Comp. 9 | 700 | 90 | 15 | 84 | 500 |
| Comp. 10 | 700 | 90 | 5 | 90 | 500 |
| Comp. 11 | 700 | 90 | 15 | 94 | 500 |
| Comp. 12 | 780 | 83 | — | 83 | — |
| Comp. 13 | 780 | 83 | — | 83 | — |

TABLE 5

| | Rolling Reduction (%) in Second Cold Rolling | Final Intermediate Annealing (° C. × sec.) | Finish Cold Rolling | | | Low Temp. Annealing (° C. × sec.) |
|---|---|---|---|---|---|---|
| | | | Rolling Reduction (%) | Back Tension (kg/mm$^2$) | Forward Tension (kg/mm$^2$) | |
| Ex. 1 | 58 | 670 × 21 | 20 | 6.9 | 15.0 | 450 × 23 |
| Ex. 2 | 60 | 670 × 18 | 16 | 6.9 | 15.0 | 450 × 23 |
| Ex. 3 | 57 | 670 × 21 | 23 | 6.9 | 15.0 | 450 × 23 |
| Ex. 4 | 58 | 670 × 19 | 20 | 7.5 | 16.6 | 450 × 23 |
| Ex. 5 | 60 | 670 × 21 | 16 | 6.2 | 13.6 | 450 × 23 |
| Ex. 6 | 58 | 670 × 21 | 20 | 6.9 | 15.0 | 450 × 23 |
| Ex. 7 | 56 | 650 × 32 | 25 | 5.5 | 10.2 | 450 × 23 |
| Ex. 8 | 56 | 670 × 21 | 25 | 6.9 | 15.0 | 450 × 23 |
| Ex. 9 | 63 | 700 × 24 | 10 | 1.6 | 5.7 | 480 × 23 |
| Ex. 10 | 60 | 720 × 12 | 16 | 3.2 | 8.3 | 450 × 23 |
| Ex. 11 | 69 | 670 × 21 | 18 | 2.6 | 7.4 | 450 × 23 |

TABLE 5-continued

| | Rolling Reduction (%) in Second Cold Rolling | Final Intermediate Annealing (° C. × sec.) | Finish Cold Rolling: Rolling Reduction (%) | Finish Cold Rolling: Back Tension (kg/mm²) | Finish Cold Rolling: Forward Tension (kg/mm²) | Low Temp. Annealing (° C. × sec.) |
|---|---|---|---|---|---|---|
| Ex. 12 | 58 | 700 × 32 | 20 | 2.6 | 7.4 | 450 × 23 |
| Ex. 13 | 60 | 700 × 18 | 16 | 6.9 | 15.0 | 450 × 23 |
| Ex. 14 | 58 | 680 × 21 | 20 | 5.5 | 10.2 | 450 × 23 |
| Ex. 14 | 60 | 700 × 21 | 16 | 4.0 | 9.1 | 450 × 23 |
| Ex. 16 | 60 | 670 × 21 | 16 | 6.2 | 13.6 | 450 × 23 |
| Ex. 17 | 60 | 670 × 25 | 16 | 4.0 | 9.1 | 450 × 23 |
| Ex. 18 | 60 | 670 × 21 | 16 | 4.0 | 9.1 | 450 × 23 |
| Ex. 19 | 60 | 685 × 21 | 16 | 6.0 | 13.6 | 450 × 23 |
| Ex. 20 | 60 | 670 × 21 | 16 | 5.5 | 10.2 | 450 × 23 |
| Ex. 21 | 62 | 610 × 21 | 12 | 6.9 | 15.0 | 450 × 23 |
| Ex. 22 | 60 | 670 × 30 | 16 | 6.2 | 13.6 | 450 × 23 |
| Ex. 23 | 63 | 560 × 25 | 16 | 1.2 | 5.2 | 450 × 23 |
| Ex. 24 | 63 | 685 × 25 | 16 | 6.9 | 15.0 | 450 × 23 |

TABLE 6

| | Rolling Reduction (%) in Second Cold Rolling | Final Intermediate Annealing (° C. × sec.) | Finish Cold Rolling: Rolling Reduction (%) | Finish Cold Rolling: Back Tension (kg/mm²) | Finish Cold Rolling: Forward Tension (kg/mm²) | Low Temp. Annealing (° C. × sec.) |
|---|---|---|---|---|---|---|
| Comp. 1 | 50 | 670 × 25 | 33 | 5.5 | 10.2 | 450 × 23 |
| Comp. 2 | 50 | 670 × 25 | 33 | 5.5 | 10.2 | 450 × 23 |
| Comp. 3 | 58 | 670 × 21 | 20 | 6.9 | 15.0 | 450 × 23 |
| Comp. 4 | 58 | 650 × 32 | 20 | 6.9 | 15.0 | 450 × 23 |
| Comp. 5 | 63 | 530 × 21 | 10 | 7.6 | 16.6 | 400 × 23 |
| Comp. 6 | 78 | 500 × 600 | 20 | 0 | 0 | 350 × 1800 |
| Comp. 7 | 76 | 500 × 600 | 16 | 0 | 0 | 350 × 1800 |
| Comp. 8 | 74 | 500 × 600 | 27 | 0 | 0 | 300 × 1800 |
| Comp. 9 | 75 | 600 × 600 | 25 | 0 | 0 | 350 × 1800 |
| Comp10 | 78 | 350 × 600 | 15 | 0 | 0 | 300 × 1800 |
| Comp. 11 | 58 | 600 × 21 | 16 | 5.5 | 10.2 | 450 × 23 |
| Comp. 12 | — | 400 × 3600 | — | — | — | — |
| Comp. 13 | — | 500 × 20 | — | — | — | — |

TABLE 7

| | Mean Crystal Grain Size (μm) | Ratio of X-ray Diffraction Intensity I{220}/{420} |
|---|---|---|
| Ex. 1 | 8 | 4.19 |
| Ex. 2 | 8 | 4.15 |
| Ex. 3 | 8 | 5.13 |
| Ex. 4 | 8 | 4.21 |
| Ex. 5 | 11 | 4.43 |
| Ex. 6 | 10 | 4.22 |
| Ex. 7 | 12 | 4.90 |
| Ex. 8 | 9 | 4.70 |
| Ex. 9 | 10 | 3.65 |
| Ex. 10 | 10 | 3.89 |
| Ex. 11 | 10 | 3.34 |
| Ex. 12 | 16 | 3.66 |
| Ex. 13 | 11 | 4.92 |
| Ex. 14 | 10 | 4.32 |
| Ex. 15 | 9 | 3.98 |
| Ex. 16 | 9 | 4.28 |
| Ex. 17 | 10 | 3.98 |
| Ex. 18 | 10 | 4.01 |
| Ex. 19 | 11 | 4.22 |
| Ex. 20 | 10 | 3.60 |
| Ex. 21 | 6 | 4.72 |

TABLE 7-continued

| | Mean Crystal Grain Size (μm) | Ratio of X-ray Diffraction Intensity I{220}/{420} |
|---|---|---|
| Ex. 22 | 12 | 4.22 |
| Ex. 23 | 5 | 2.52 |
| Ex. 24 | 14 | 2.82 |

TABLE 8

| | Mean Crystal Grain Size (μm) | Ratio of X-ray Diffraction Intensity I{220}/{420} |
|---|---|---|
| Comp. 1 | 11 | 2.60 |
| Comp. 2 | 10 | 3.76 |
| Comp. 3 | 9 | 3.59 |
| Comp. 4 | 8 | 4.30 |
| Comp. 5 | 2 | 8.50 |
| Comp. 6 | 10 | 1.82 |
| Comp. 7 | 9 | 1.78 |
| Comp. 8 | 10 | 1.90 |
| Comp. 9 | 15 | 1.72 |
| Comp. 10 | 2 | 2.40 |
| Comp. 11 | 10 | 3.56 |
| Comp. 12 | 1.3 | 2.10 |
| Comp. 13 | 2 | 2.40 |

TABLE 9

| | Conductivity (% IACS) | 0.2% Proof Stress LD (MPa) | 0.2% Proof Stress TD (MPa) | 0.2% Proof Stress TD/LD | Tensile Strength LD (MPa) | Tensile Strength TD (MPa) | Tensile Strength TD/LD | Breaking Elongation (%) LD | Breaking Elongation (%) TD |
|---|---|---|---|---|---|---|---|---|---|
| Ex. 1 | 10.3 | 610 | 664 | 1.09 | 678 | 731 | 1.08 | 22.2 | 12.7 |
| Ex. 2 | 10.2 | 557 | 589 | 1.06 | 641 | 683 | 1.07 | 27.4 | 19.5 |
| Ex. 3 | 9.8 | 625 | 670 | 1.07 | 699 | 741 | 1.06 | 18.6 | 10.2 |
| Ex. 4 | 10.0 | 581 | 615 | 1.06 | 660 | 701 | 1.06 | 26.9 | 17.3 |
| Ex. 5 | 9.6 | 588 | 629 | 1.07 | 648 | 690 | 1.06 | 21.7 | 16.2 |
| Ex. 6 | 9.7 | 589 | 622 | 1.06 | 661 | 707 | 1.07 | 21.8 | 15.9 |
| Ex. 7 | 13.0 | 572 | 611 | 1.07 | 645 | 691 | 1.07 | 25.4 | 17.6 |
| Ex. 8 | 13.2 | 569 | 601 | 1.06 | 648 | 688 | 1.06 | 24.9 | 16.5 |
| Ex. 9 | 8.6 | 591 | 644 | 1.09 | 655 | 700 | 1.07 | 23.1 | 15.2 |
| Ex. 10 | 8.7 | 576 | 609 | 1.06 | 642 | 678 | 1.06 | 22.4 | 13.6 |
| Ex. 11 | 9.9 | 572 | 606 | 1.06 | 645 | 681 | 1.06 | 28.9 | 18.7 |
| Ex. 12 | 10.2 | 564 | 602 | 1.07 | 637 | 679 | 1.07 | 25.4 | 16.0 |
| Ex. 13 | 9.3 | 569 | 630 | 1.11 | 648 | 701 | 1.08 | 25.8 | 15.1 |
| Ex. 14 | 10.0 | 546 | 599 | 1.10 | 651 | 696 | 1.07 | 26.0 | 15.3 |
| Ex. 15 | 9.7 | 567 | 604 | 1.07 | 644 | 686 | 1.07 | 26.2 | 15.8 |
| Ex. 16 | 10.2 | 564 | 600 | 1.06 | 647 | 691 | 1.07 | 27.2 | 18.3 |
| Ex. 17 | 9.8 | 569 | 599 | 1.05 | 642 | 692 | 1.08 | 28.5 | 19.4 |
| Ex. 18 | 9.6 | 551 | 590 | 1.07 | 637 | 688 | 1.08 | 30.1 | 18.8 |
| Ex. 19 | 10.5 | 571 | 604 | 1.06 | 648 | 691 | 1.07 | 29.0 | 17.2 |
| Ex. 20 | 9.9 | 565 | 602 | 1.07 | 647 | 691 | 1.07 | 25.2 | 15.3 |
| Ex. 21 | 9.6 | 615 | 669 | 1.09 | 684 | 732 | 1.07 | 19.4 | 12.1 |
| Ex. 22 | 10.1 | 571 | 605 | 1.06 | 644 | 688 | 1.07 | 28.1 | 16.7 |
| Ex. 23 | 9.9 | 558 | 589 | 1.06 | 639 | 675 | 1.06 | 30.1 | 17.4 |
| Ex. 24 | 9.7 | 474 | 500 | 1.05 | 565 | 595 | 1.05 | 34.4 | 27.2 |

TABLE 10

| | Conductivity | 0.2% Proof Stress | | | Tensile Strength | | | Breaking Elongation (%) | |
|---|---|---|---|---|---|---|---|---|---|
| | (% IACS) | LD (MPa) | TD (MPa) | TD/LD | LD (MPa) | TD (MPa) | TD/LD | LD | TD |
| Comp. 1 | 24.1 | 561 | 595 | 1.06 | 639 | 688 | 1.08 | 16.4 | 7.4 |
| Comp. 2 | 25.5 | 562 | 592 | 1.05 | 635 | 681 | 1.07 | 14.2 | 6.8 |
| Comp. 3 | 11.0 | 560 | 595 | 1.06 | 638 | 683 | 1.07 | 29.8 | 15.3 |
| Comp. 4 | 10.1 | 532 | 578 | 1.09 | 626 | 667 | 1.07 | 24.3 | 13.8 |
| Comp. 5 | 9.8 | 650 | 698 | 1.07 | 711 | 766 | 1.08 | 26.7 | 14.1 |
| Comp. 6 | 10.1 | 524 | 536 | 1.02 | 639 | 655 | 1.03 | 33.7 | 19.9 |
| Comp. 7 | 10.3 | 531 | 542 | 1.02 | 640 | 659 | 1.03 | 32.6 | 17.8 |
| Comp. 8 | 14.2 | 576 | 587 | 1.02 | 620 | 641 | 1.03 | 16.4 | 6.8 |
| Comp. 9 | 9.6 | 535 | 545 | 1.02 | 610 | 631 | 1.03 | 17.2 | 7.3 |
| Comp. 10 | 9.0 | 520 | 533 | 1.03 | 639 | 650 | 1.02 | 26.2 | 18.7 |
| Comp. 11 | 9.8 | 487 | 537 | 1.10 | 623 | 669 | 1.07 | 27.7 | 19.4 |
| Comp. 12 | 12.0 | 708 | 755 | 1.07 | 795 | 848 | 1.07 | 10.0 | 4.2 |
| Comp. 13 | 11.5 | 730 | 775 | 1.06 | 815 | 868 | 1.07 | 10.3 | 4.1 |

TABLE 11

| | Stress Relaxation Rate | Stress Corrosion Cracking Resistance | | Bending Workability | | |
|---|---|---|---|---|---|---|
| | (%) LD | Time (h) | Ratio to C2600 | LD (R/t) | TD (R/t) | LD/TD |
| Ex. 1 | 28 | 144 | 29 | 0.3 | 0.7 | 0.43 |
| Ex. 2 | 20 | 170 | 34 | 0.3 | 0.3 | 1.00 |
| Ex. 3 | 24 | 168 | 34 | 0.3 | 1.7 | 0.18 |
| Ex. 4 | 23 | 141 | 28 | 0.3 | 0.3 | 1.00 |
| Ex. 5 | 21 | 201 | 40 | 0.3 | 0.3 | 1.00 |
| Ex. 6 | 20 | 240 | 48 | 0.3 | 0.6 | 0.50 |
| Ex. 7 | 27 | 155 | 31 | 0.3 | 0.6 | 0.50 |
| Ex. 8 | 26 | 125 | 25 | 0.3 | 0.3 | 1.00 |
| Ex. 9 | 22 | 171 | 34 | 0.3 | 0.3 | 1.00 |
| Ex. 10 | 24 | 110 | 22 | 0.3 | 0.6 | 0.50 |
| Ex. 11 | 23 | 149 | 30 | 0.3 | 0.3 | 1.00 |
| Ex. 12 | 31 | 138 | 28 | 0.3 | 0.3 | 1.00 |
| Ex. 13 | 25 | 182 | 36 | 0.3 | 0.3 | 1.00 |
| Ex. 14 | 26 | 122 | 24 | 0.3 | 0.3 | 1.00 |
| Ex. 15 | 25 | 169 | 34 | 0.3 | 0.3 | 1.00 |
| Ex. 16 | 23 | 168 | 34 | 0.3 | 0.3 | 1.00 |
| Ex. 17 | 21 | 186 | 37 | 0.3 | 0.3 | 1.00 |
| Ex. 18 | 22 | 182 | 36 | 0.3 | 0.3 | 1.00 |
| Ex. 19 | 24 | 174 | 35 | 0.3 | 0.3 | 1.00 |
| Ex. 20 | 21 | 112 | 22 | 0.3 | 0.3 | 1.00 |
| Ex. 21 | 32 | 184 | 37 | 0.3 | 0.7 | 0.43 |
| Ex. 22 | 25 | 197 | 39 | 0.3 | 0.3 | 1.00 |
| Ex. 23 | 28 | 194 | 39 | 0.3 | 0.3 | 1.00 |
| Ex. 24 | 17 | 192 | 38 | 0.3 | 0.3 | 1.00 |

TABLE 12

| | Stress Relaxation Rate | Stress Corrosion Cracking Resistance | | Bending Workability | | |
|---|---|---|---|---|---|---|
| | (%) LD | Time (h) | Ratio to C2600 | LD (R/t) | TD (R/t) | LD/TD |
| Comp. 1 | 40 | 40 | 8 | 1.2 | 2.0 | 0.60 |
| Comp. 2 | 41 | 8 | 1.6 | 1.2 | 2.7 | 0.44 |
| Comp. 3 | 24 | 84 | 17 | 0.3 | 0.3 | 1.00 |
| Comp. 4 | 29 | 92 | 18 | 0.3 | 0.6 | 0.50 |
| Comp. 5 | 45 | 171 | 34 | 1.2 | 1.2 | 1.00 |

TABLE 12-continued

| | Stress Relaxation Rate | Stress Corrosion Cracking Resistance | | Bending Workability | | |
|---|---|---|---|---|---|---|
| | (%) LD | Time (h) | Ratio to C2600 | LD (R/t) | TD (R/t) | LD/TD |
| Comp. 6 | 33 | 165 | 33 | 0.3 | 0.3 | 1.00 |
| Comp. 7 | 26 | 199 | 40 | 0.3 | 0.3 | 1.00 |
| Comp. 8 | 37 | 135 | 27 | 0.3 | 0.3 | 1.00 |
| Comp. 9 | 33 | 189 | 38 | 0.3 | 0.6 | 0.50 |
| Comp. 10 | 40 | 180 | 36 | 0.3 | 0.6 | 0.50 |
| Comp. 11 | 20 | 75 | 15 | 0.3 | 0.3 | 1.00 |
| Comp. 12 | 48 | 166 | 33 | 1.2 | 2.0 | 0.60 |
| Comp. 13 | 44 | 182 | 36 | 1.2 | 2.0 | 0.60 |

The invention claimed is:

1. A copper alloy plate which has a chemical composition comprising 17 to 32% by weight of zinc, 0.1 to 4.5% by weight of tin, 1.38 to 2.5% by weight of silicon, 0.01 to 0.3% by weight of phosphorus, and the balance being copper and unavoidable impurities, the total of the content of silicon and six times as much as the content of phosphorus being 1.44% by weight or more, the copper alloy plate having a crystal orientation wherein I{220}/I{420} is in the range of from 2.5 to 8.0 assuming that the X-ray diffraction intensity on {220} crystal plane on the plate surface of the copper alloy plate is I{220} and that the X-ray diffraction intensity on {420} crystal plane thereon is I{420}.

2. A copper alloy plate as set forth in claim 1, wherein the chemical composition of the copper alloy plate further comprises 1% by weight or less of nickel.

3. A copper alloy plate as set forth in claim 1, wherein the chemical composition of the copper alloy plate further comprises one or more elements which are selected from the group consisting of cobalt, iron, chromium, manganese, magnesium, zirconium, titanium, antimony, aluminum, boron, lead, bismuth, cadmium, gold, silver, beryllium, tellurium, yttrium and arsenic, the total amount of these elements being 3% by weight or less.

4. A copper alloy plate as set forth in claim 1, which has a mean crystal grain size of 3 to 20 μm.

5. A copper alloy plate as set forth in claim 1, which has a tensile strength of not lower than 650 MPa when a tension test based on JIS 22241 is carried out with respect to a test piece TD (No. 5 test piece based on JIS 22201) for tension test, the test piece being cut out from the copper alloy plate, the longitudinal directions of the test piece being directions TD (directions perpendicular to the rolling and thickness directions of the copper alloy plate) while the width directions of the test piece being directions LD (rolling directions of the copper alloy plate).

6. A copper alloy plate as set forth in claim 5, which has a tensile strength of not lower than 550 MPa when a tension test based on JIS 22241 is carried out with respect to a test piece LD (No. 5 test piece based on JIS 22201) for tension test, the test piece being cut out from the copper alloy plate, the longitudinal directions of the test piece being directions LD (rolling directions of the copper alloy plate) while the width directions of the test piece being directions TD (directions perpendicular to the rolling and thickness directions of the copper alloy plate).

7. A copper alloy plate as set forth in claim 6, wherein a ratio of the tensile strength of the test piece TD to the tensile strength of the test piece LD is not less than 1.05.

8. A method for producing a copper alloy plate, the method comprising the steps of:

melting and casting raw materials of a copper alloy which has a chemical composition comprising 17 to 32% by weight of zinc, 0.1 to 4.5% by weight of tin, 1.38 to 2.5% by weight of silicon, 0.01 to 0.3% by weight of phosphorus, and the balance being copper and unavoidable impurities, the total of the content of silicon and six times as much as the content of phosphorus being 1.44% by weight or more;

hot-rolling the cast copper alloy at a rolling reduction of 90% or more in a temperature range of from 900° C. to 300° C., the hot-rolling being carried out at a rolling reduction of 10% or more in a rolling path in a temperature range of 650° C. or lower;

first cold-rolling the hot-rolled copper alloy at a rolling reduction of 50% or more;

carrying out an intermediate-annealing for holding the first-cold-rolled copper alloy at a temperature of 400 to 800° C. for 1 hour or more;

second cold-rolling the intermediate-annealed copper alloy at a rolling reduction of 40% or more;

carrying out a final intermediate-annealing for holding the second-cold-rolled copper alloy at a temperature of 550 to 850° C. for 60 seconds or less;

finish cold-rolling the final intermediate-annealed copper alloy at a rolling reduction of 30% or less; and carrying out a low-temperature annealing for holding the finish-cold-rolled copper alloy at a temperature of 500° C. or lower, the copper alloy plate having a crystal orientation wherein I{220}/I{420} is in the range of from 2.5 to 8.0 assuming that the X-ray diffraction intensity on {220} crystal plane on the plate surface of the copper alloy plate is I{220} and that the X-ray diffraction intensity on {420} crystal plane thereon is I{420}.

9. A method for producing a copper alloy plate as set forth in claim 8, wherein the chemical composition of the copper alloy plate further comprises 1% by weight or less of nickel.

10. A method for producing a copper alloy plate as set forth in claim 8, wherein the chemical composition of the copper alloy plate further comprises one or more elements which are selected from the group consisting of cobalt, iron, chromium, manganese, magnesium, zirconium, titanium, antimony, aluminum, boron, lead, bismuth, cadmium, gold, silver, beryllium, tellurium, yttrium and arsenic, the total amount of these elements being 3% by weight or less.

11. A method for producing a copper alloy plate as set forth in claim 8, wherein the final intermediate-annealing causes the copper alloy to have a mean crystal grain size of 3 to 20 μm.

12. A method for producing a copper alloy plate as set forth in claim 8, wherein the finish cold-rolling is carried out by setting a back tension of not lower than 1 $kg/mm^2$ and a forward tension of not lower than 5 $kg/mm^2$.

13. A connector terminal, the material of which is a copper alloy plate as set forth in claim 1.

14. A copper alloy plate as set forth in claim 1, wherein the content of silicon in the copper alloy plate is 1.53% by weight or more, and the total of the content of silicon and six times as much as the content of phosphorus being 1.59% by weight or more.

* * * * *